United States Patent [19]

Kurita et al.

[11] 4,025,180

[45] May 24, 1977

[54] TRANSFER TYPE ELECTROPHOTOGRAPHIC COPYING APPARATUS

[75] Inventors: Takaji Kurita, Kawachinagano; Tetsuya Utsumi, Toyokawa; Hiroshi Ikeda, Toyokawa; Masaru Komura, Toyokawa; Shin Miyata, Toyokawa; Yoshihisa Kawai, Hommachi; Kenichi Arai, Toyokawa, all of Japan

[73] Assignee: Minolta Camera Kabushiki Kaisha, Osaka, Japan

[22] Filed: Sept. 18, 1975

[21] Appl. No.: 614,603

Related U.S. Application Data

[63] Continuation of Ser. No. 518,942, Oct. 29, 1974, abandoned.

[30] Foreign Application Priority Data

Oct. 30, 1973 Japan ..... 48-122521
Mar. 8, 1974 Japan ..... 49-27562

[52] U.S. Cl. ..... 355/3 R; 355/16
[51] Int. Cl.² ..... G03G 15/00
[58] Field of Search ..... 355/16, 17, 11, 3 R, 355/3 FU; 271/DIG. 2

[56] References Cited

UNITED STATES PATENTS

| | | | |
|---|---|---|---|
| 3,575,502 | 4/1971 | Eppe | 355/3 R |
| 3,583,805 | 6/1971 | Tanaka | 355/3 FU |
| 3,661,452 | 5/1972 | Hewes et al. | 355/3 R |
| 3,689,146 | 9/1972 | Ito et al. | 355/3 R |
| 3,700,218 | 10/1972 | Laisney | 355/3 FU |
| 3,770,346 | 11/1973 | Jordan | 355/3 R |
| 3,819,261 | 6/1974 | Ogawa | 355/11 X |
| 3,867,026 | 2/1975 | Ogawa | 355/16 X |

*Primary Examiner*—R. L. Moses
*Attorney, Agent, or Firm*—Wenderoth, Lind & Ponack

[57] ABSTRACT

A transfer type electrophotographic copying apparatus for high speed copying system which includes a photoconductive photoreceptor in the form of an endless belt and movably suspended by a plurality of rollers so as to provide a plurality of flat surfaces. A flat portion which is formed on the photoreceptor belt facing a transfer corona charger and which is directed approximately parallel to a path of a copy paper sheet is effective for shortening the length of the paper path and for improving transferred images, while blower means disposed in a fixing device is adapted to assist in the separation of the copied paper from the photoreceptor belt in normal copying operation, and to direct cooling air to the fixing device in case of paper jamming. Heat shielding means is disposed between the fixing device and the photoreceptor belt.

11 Claims, 28 Drawing Figures

(a)

Figure 1:
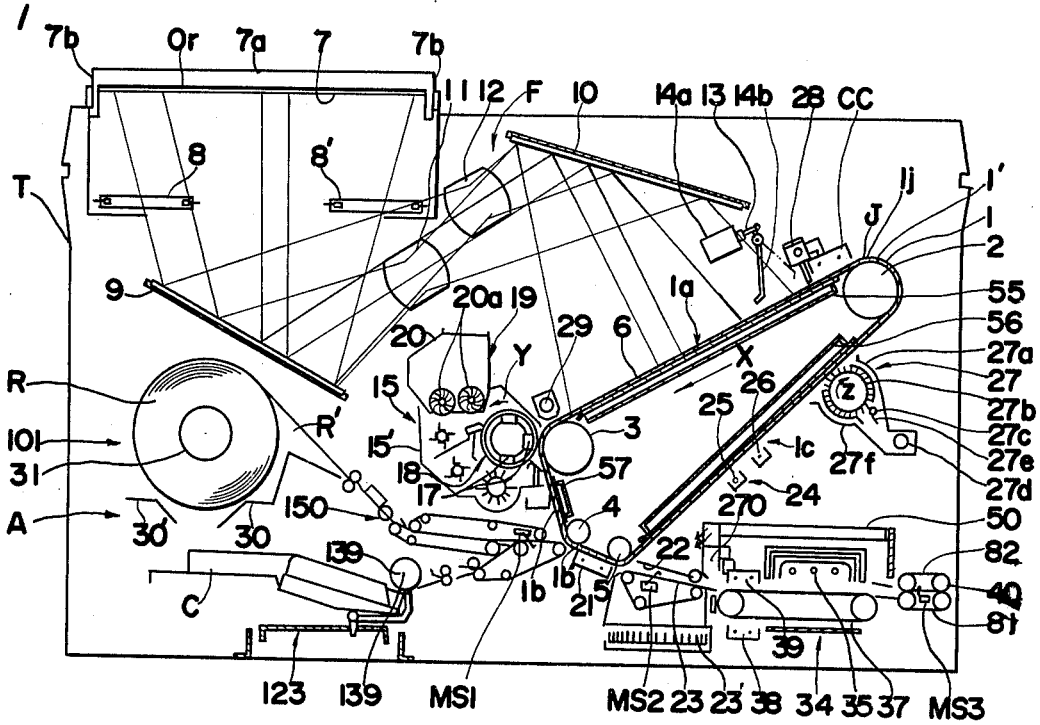

| Sequence of cam operation | 1b | 9b | 2b | 7b | 8b | 4b | 3b | 5b | 6b | 1b | 9b | 2b | 7b | 8b |
|---|---|---|---|---|---|---|---|---|---|---|---|---|---|---|
| Sequence of operation for electrical circuit: First copy | ○ | | ○ | | | | ○ | ○ | ○ | | | | ○ | |
| Second copy | | | | | | | | | | ○ | | ○ | | |
| Third copy | | | | | | | | | | | | | | |

| | 4b | 3b | 5b | 6b | 1b | 9b | 2b | 7b | 8b | 4b | 3b | 5b | 6b | 1b | 9b | 2b | 7b |
|---|---|---|---|---|---|---|---|---|---|---|---|---|---|---|---|---|---|
| First copy | ○ | | | | | | | | ○ | | | | | | ○ | | |
| Second copy | | ○ | ○ | ○ | | | | ○ | | ○ | | | | | | | |
| Third copy | | | | | ○ | | ○ | | | | ○ | ○ | ○ | | | | ○ |

| | 8b | 4b | 3b | 5b | 6b | 1b | 9b | 2b | 7b | 8b | 4b | 3b | 5b | 6b | 1b | 9b |
|---|---|---|---|---|---|---|---|---|---|---|---|---|---|---|---|---|
| First copy | | | | | | | | | | | | | | | | ○ |
| Second copy | ○ | | | | | | ○ | | | | | | | | | |
| Third copy | | ○ | | | | | | | | ○ | | | | | | |

FIG. 27

TRANSFER TYPE ELECTROPHOTOGRAPHIC COPYING APPARATUS

This is a continuation, of application Ser. No. 518,942, filed Oct. 29,1974 now abandoned.

This invention relates to a copying apparatus and, more particularly, to a transfer type electrophotographic copying apparatus of the total exposure system type.

Conventionally, in the so called Carlson type electrophotographic copying apparatus of using the xerographic system, a movable photosensitive photoreceptor in the form of a drum is widely employed, around which photoreceptor drum processing stations such as a corona charging station for imparting electrical charge to the photoreceptor surface, an exposure station for forming an electrostatic latent image of an original on a platform on the photoreceptor surface through a light source and an optical system and which exposure station is disposed between the platform and the photoreceptor surface, a developing station for developing the latent image into a visible toner powder image, a transfer station in which the toner powder image is transferred onto a sheet of copy paper and which is provided with separation means for separating the paper sheet from the photoreceptor surface, a residual toner removing device for removing residual toner particles from the photoreceptor belt, and a fixing device for fixing the copy carrying paper sheet by heater means.

In the conventional copying apparatus of the above described type, although the size of the apparatus may be reduced to a certain extent by the adoption of a drum shaped photoreceptor, it is not possible to effect a high speed copying operation because of the limited amount of time which can be cut off one copying operation, particularly in continuous copying, since the latent image of the original to be copied is formed on the photoreceptor surface by a slit exposure during rotation of the photoreceptor drum in association with the movement of the platform or the movement of the optical system disposed between the platform and the photoreceptor drum.

In recent years, a high speed electrophotographic copying apparatus of the total momentary exposure type having a photoreceptor in the configuration of an endless belt movably suspended by a plurality of supporting rollers has been proposed, for example, in U.S. Pat. No. 3,661,452, for achieving high speed copying, which copying apparatus, however, has such disadvantages that the photoreceptor belt in the form of a jointless or seamless endless belt is difficult to mass produce with consequent extreme high cost, although such a belt is advantageous because, when suspended on the supporting rollers, the jointless endless belt requires no setting to a datum position for forming the latent images. Moreover, especially in single sheet copying, it is necessary to stop the endless belt after exactly one rotation thereof because of the arrangement of various elements such as the developing device, the transfer device, the cleaner device, etc., disposed along the path of the endless belt, which necessitates a particular portion on the photoreceptor surface to be repeatedly used for latent image formation, resulting in extreme fatigue or deterioration in that specific portion of the photoreceptor surface. Furthermore, since the transfer is effected at a curved portion of the photoreceptor belt supported by one of the supporting rollers, it is difficult to uniformly charge the photoreceptor surface electrostatically and the area available for transfer is limited and the copying speed is retarded, while, moreover in the separation of the copied paper sheet, the mechanical separating meand required tends to blur or brush the copied images. Additionally, in the conventional copying apparatus of the above described type. the temperature in the fixing device is liable to rise in during the copying operation by heat dissipated by the heater means, which temperature rise may cause not only the deterioration of the photoreceptor surface and fusing of toner power in the cleaner means. but is dangerous should paper jamming occur in the fixing device.

Accordingly, an essential object of the present invention is to provide an electrophotographic copying apparatus of total exposure type which is suitable for high speed copying with substantial elimination of the disadvantages inherent in the conventional copying apparatuses.

Another important object of the present invention is to provide an electrophotographic copying apparatus of the above described type in which a photoreceptor in the form of an endless belt having a joint advantageously employed in such a manner that difficult portions of the photoreceptor surface are sequentially used for latent image formations so as to avoid fatigue or deterioration of a specific portion of the photoreceptor surface with consequent low manufacturing cost and prolonged life of the photoreceptor.

A further object of the present invention is to provide an electrophotographic copying apparatus of the above described type in which the photoreceptor belt is provided with a flat portion for an efficient and uniform transfer operation.

A still further object of the present invention is to provide an electrophotographic copying apparatus of the above described type which requires no mechanical copy paper sheet separation means after transfer for the formation of definite and clear copied images.

Another object of the present invention is to provide an electrophotographic copying apparatus of the above described type which is free from any fire hazard even in case of paper jamming.

According to a preferred embodiment of the present invention, the copying apparatus includes a photoreceptor in the form of an endless belt having a joint, on the surface of which photoreceptor belt at least more than three equally sized latent image forming portions are provided along the entire length of the photoreceptor belt, and which photoreceptor endless belt is movably suspended by a plurality of rollers including a driving roller in an approximate triangular shape. A datum position is position on the photoreceptor belt so that the joint or seam portion of the photoreceptor belt does not hinder the latent image formation on the photoreceptor surface of the belt, and in single sheet copying, different portions of the photoreceptor surface are adapted to be sequentially used for the latent image formation so as to avoid early deterioration of a specific portion of the photoreceptor surface, while, in continuous copying, the entire length of the photoreceptor surface is adapted to be used in integral multiples more than three times the most commonly used size for complete utilization of the entire photoreceptor surface, which arrangement, together with the total exposure system adopted, makes it possible to continuously obtain at least three copies per one revolution of the photoreceptor belt. More particularly, since a flat surface which is formed on the portion of the photoreceptor belt supported by a driving roller and an idle roller, and which faces a transfer corona charger is adapted to be approximately parallel to the direction of advance of the copy paper sheet with the path for paper transportation shortened to form an approximate straight line, the toner powder image formed on the photoreceptor surface by a developing device is rapidly and uniformly transferred onto the sheet of copy paper and the copy carrying paper sheet is subsequently separated from the photoreceptor surface at the curved portion of the photoreceptor belt supported by the driving roller, mainly by the resilience of the sheet of copy paper. Furthermore, since blower means provided in a fixing device disposed below the transfer corona charger is adapted to direct an air flow in a direction to assist in the copy paper separation in the normal copying operation, and to direct cooling air into the fixing device in case of emergency, such as paper jamming, with heat shielding means acting as an air curtain being disposed between the photoreceptor belt and the fixing means, not only are the fire hazards minimized, but deterioration of the photosensitive surface and the possible fusing of residual toner powder in the residual toner removing device are advantageously prevented.

Figure 2:
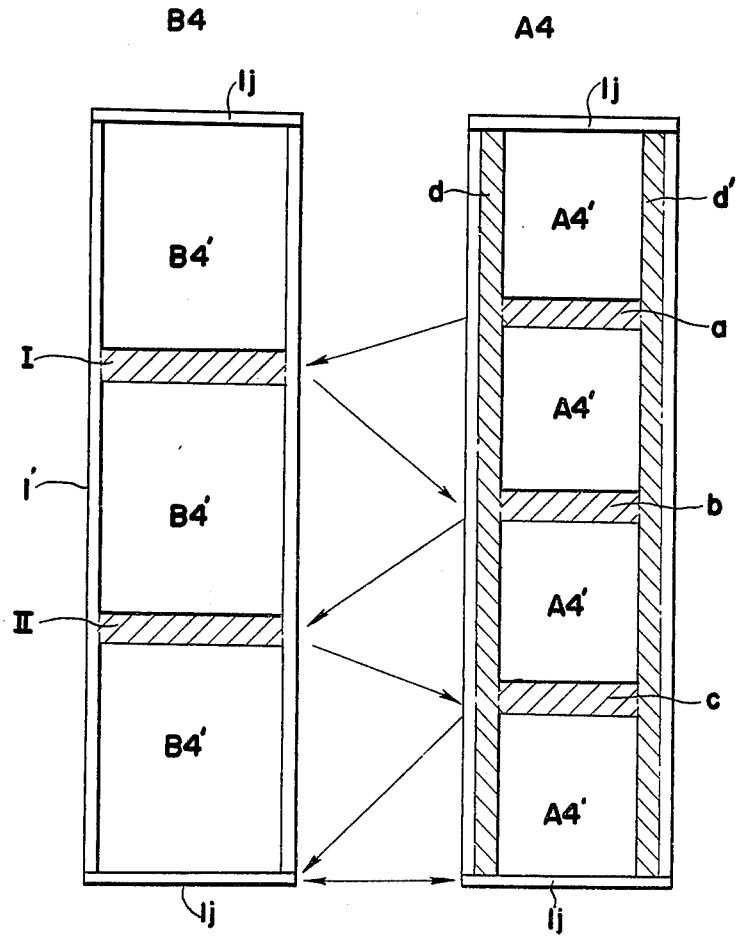

These and other objects and features of the present invention will become apparent from the following description taken in conjunction with the preferred embodiment thereof with reference to the accompanying drawings, in which;

FIG. 1 is a schematic diagram showing a sectional side view of a copying machine according to the present invention, FIG. 2 is a schematic diagram of a photosensitive endless belt shown as a length of belt divided for A4 size four sheet copying and for B4 size three sheet copying.

Figure 3:
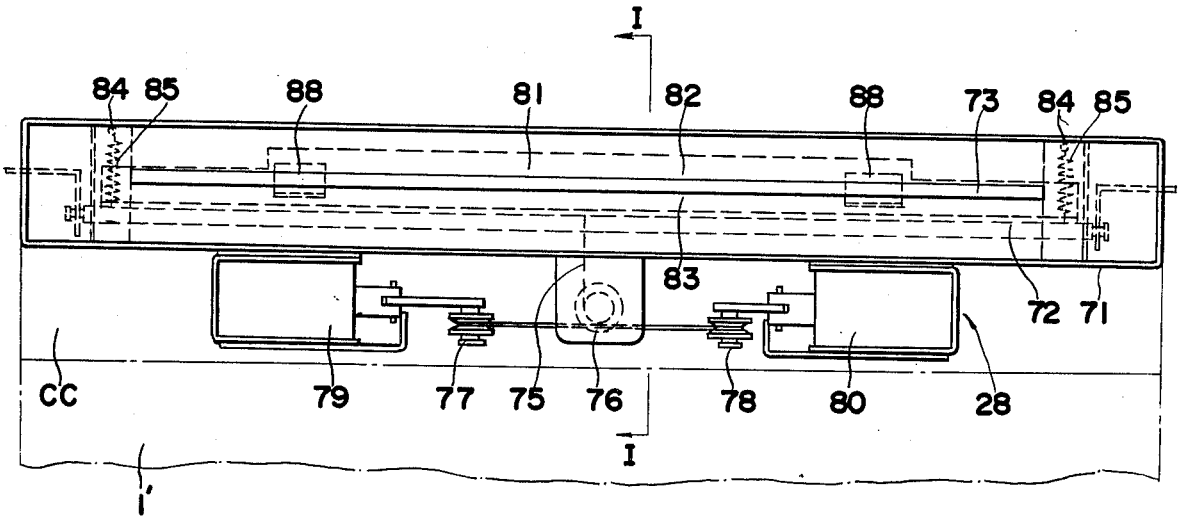
Figure 4:
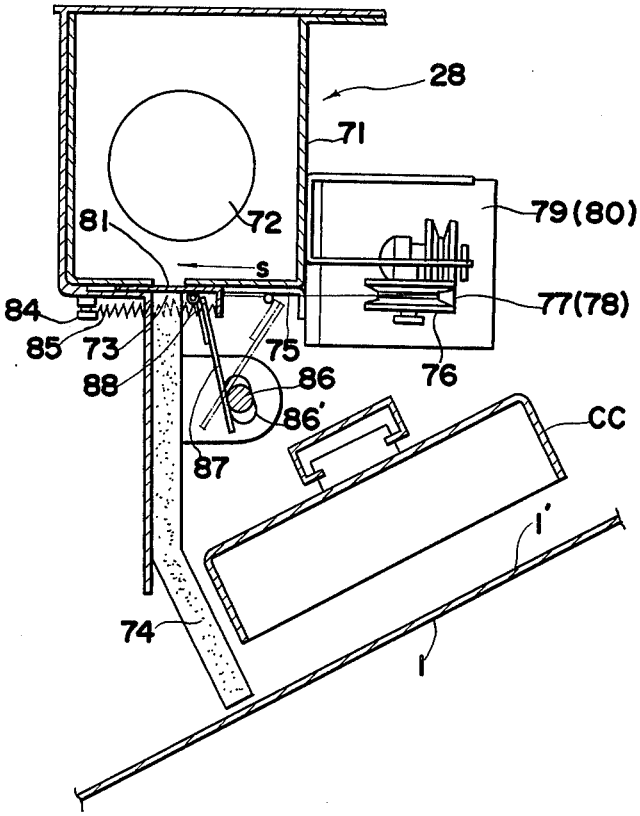
Figure 5:
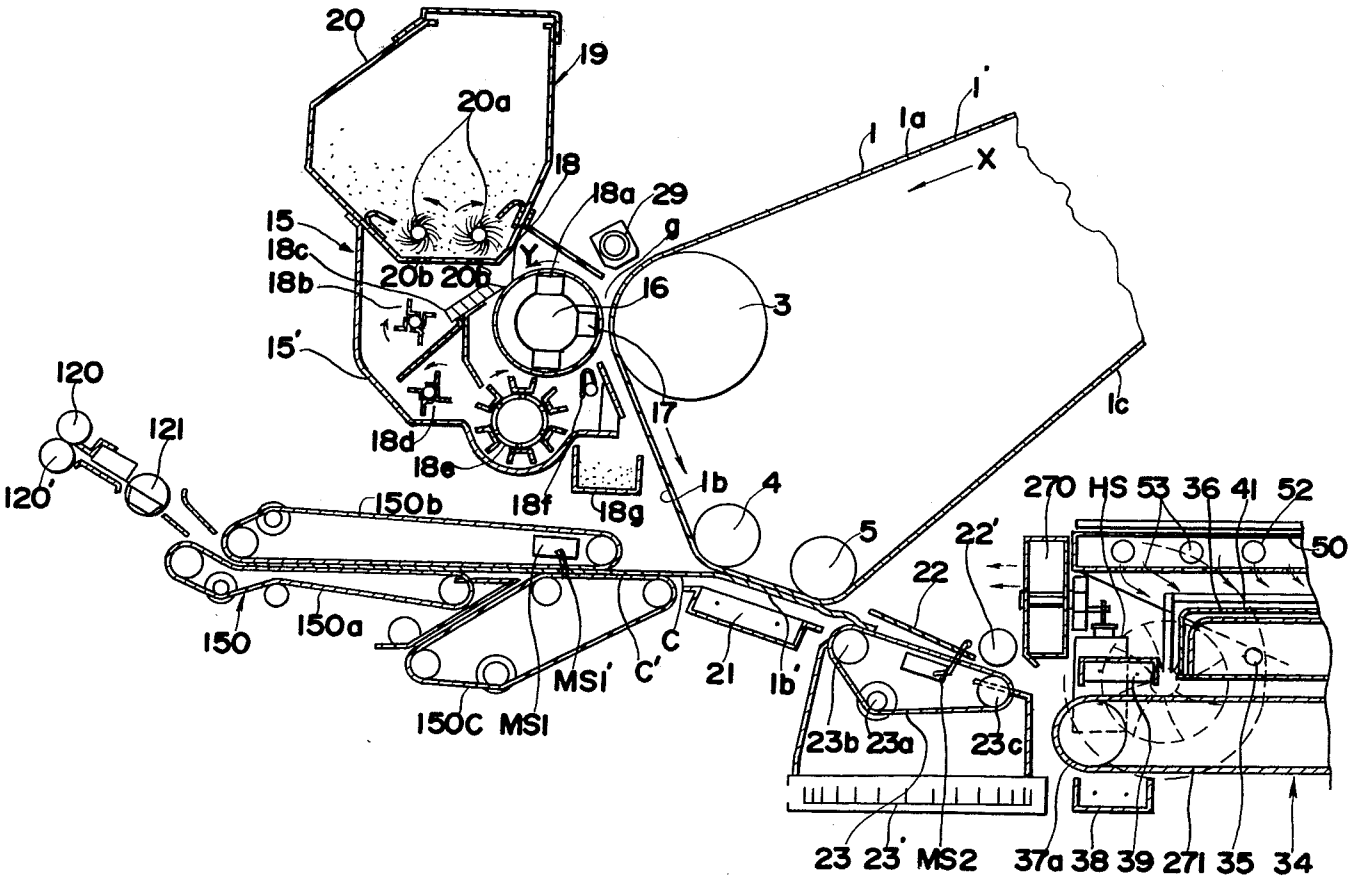
Figure 6:
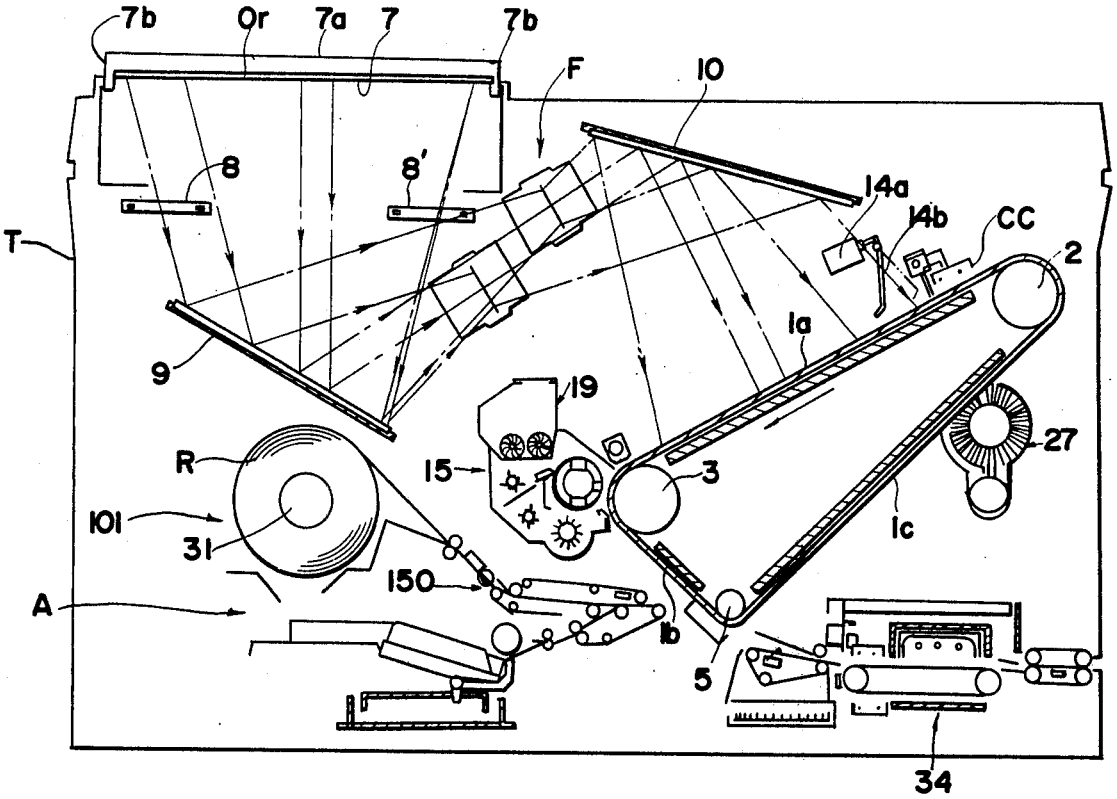
Figure 7:
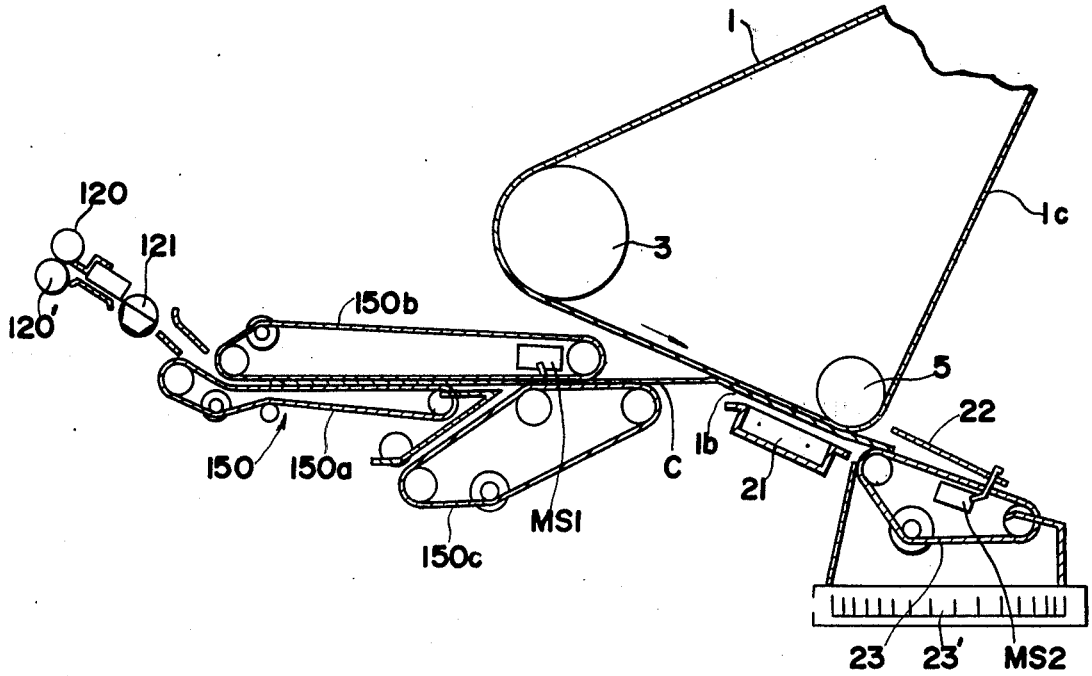
Figure 8:
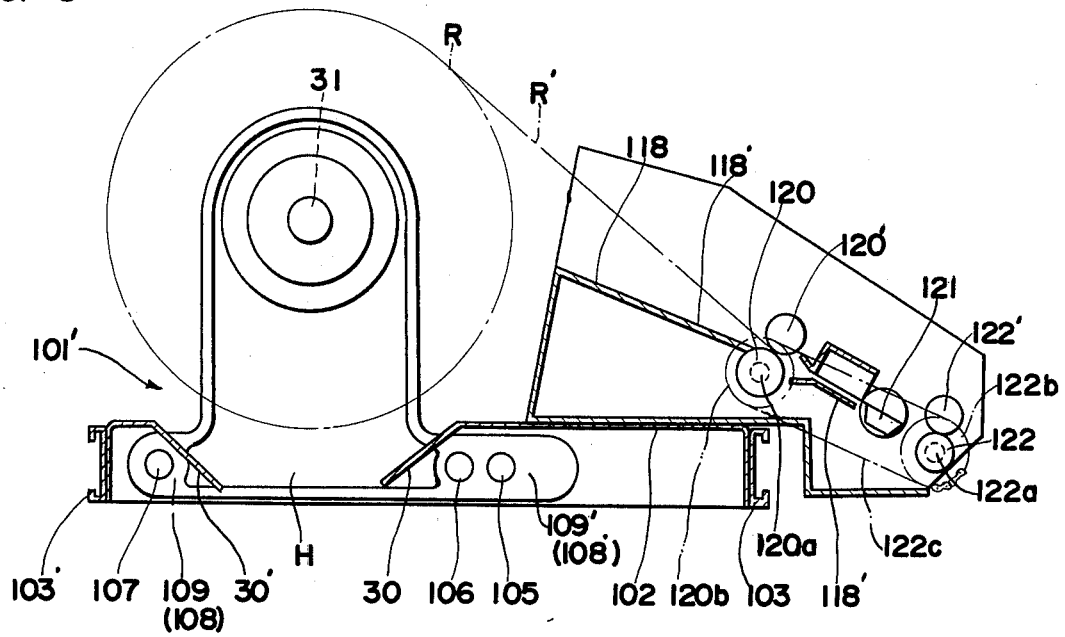
Figure 10:
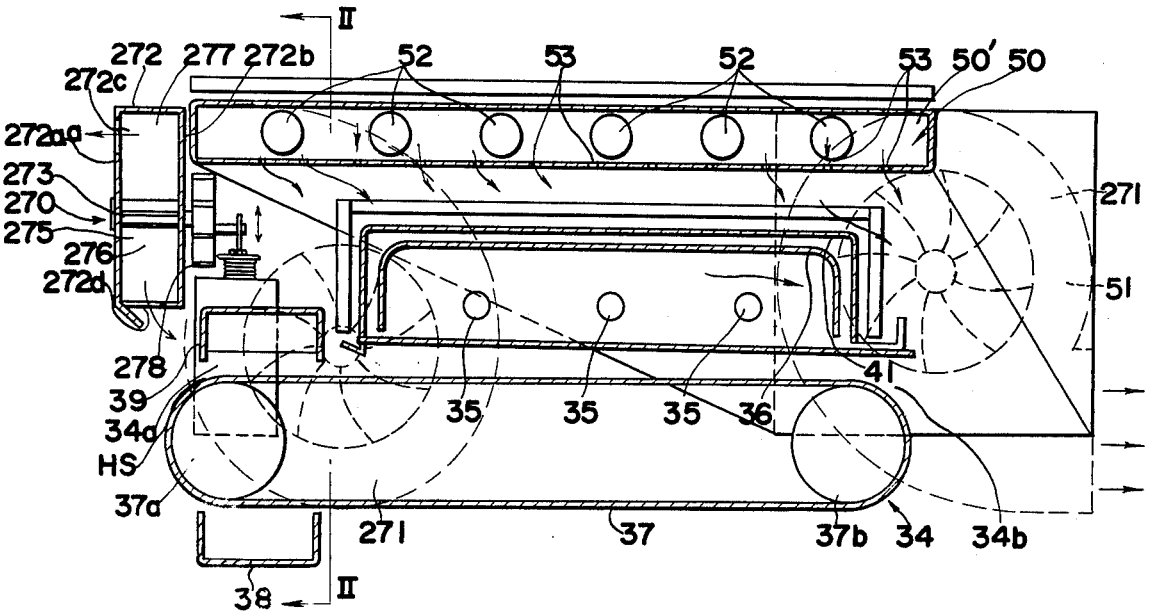
Figure 9:
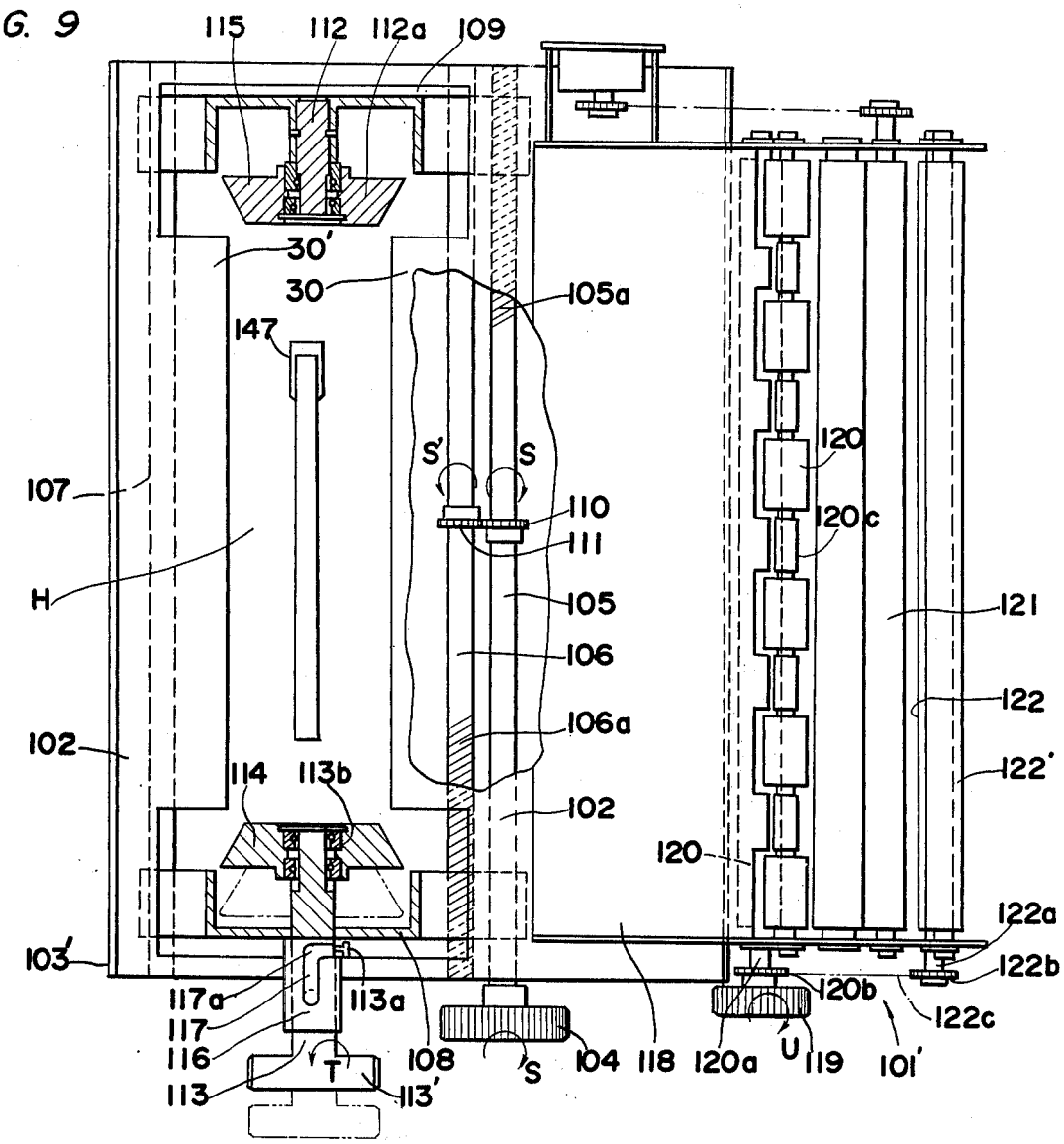
Figure 11:
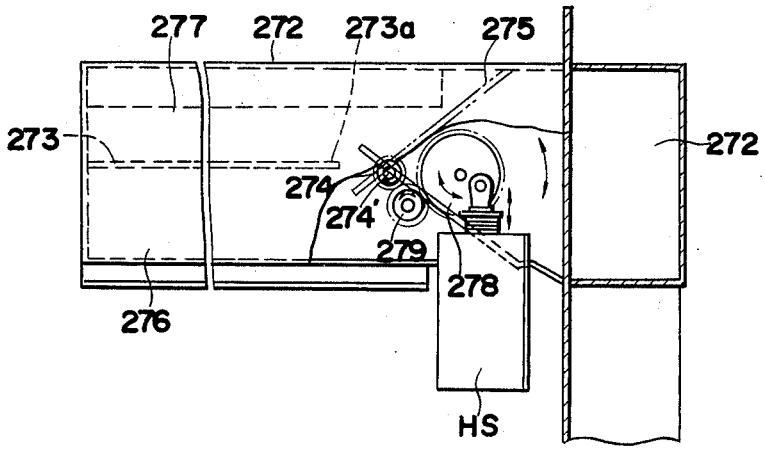
Figure 12:
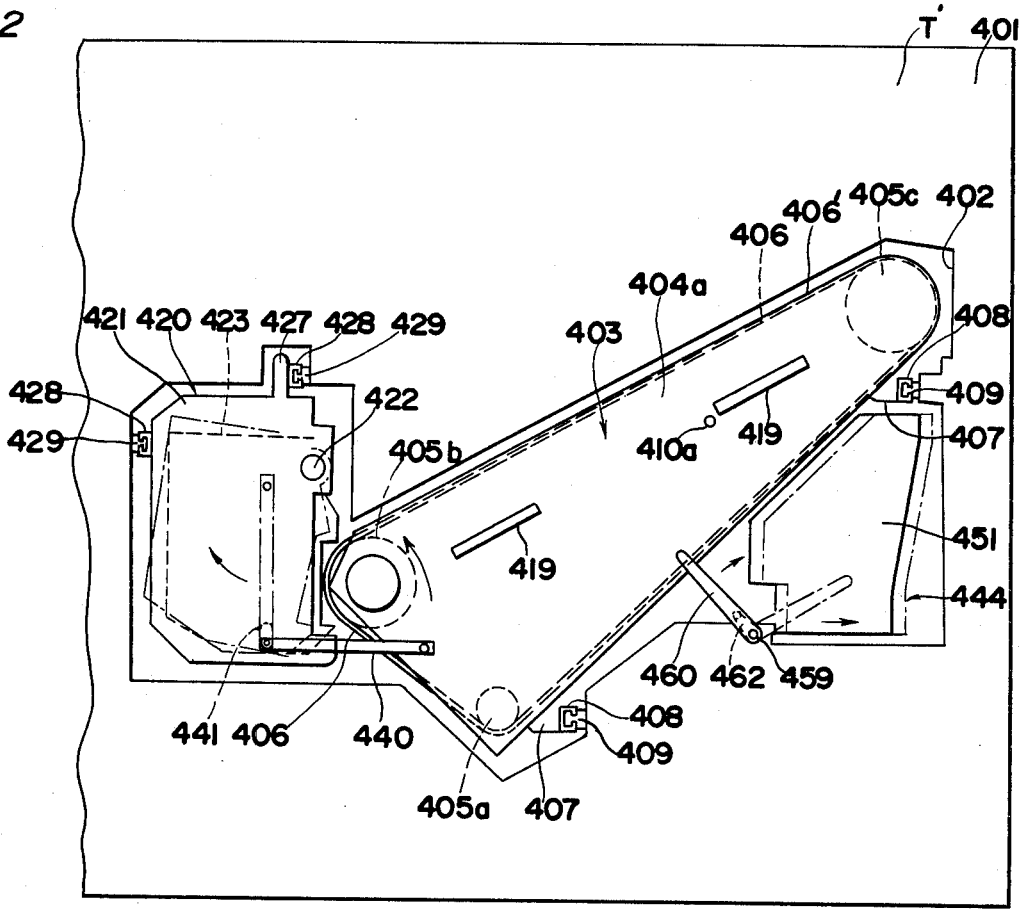
Figure 15:
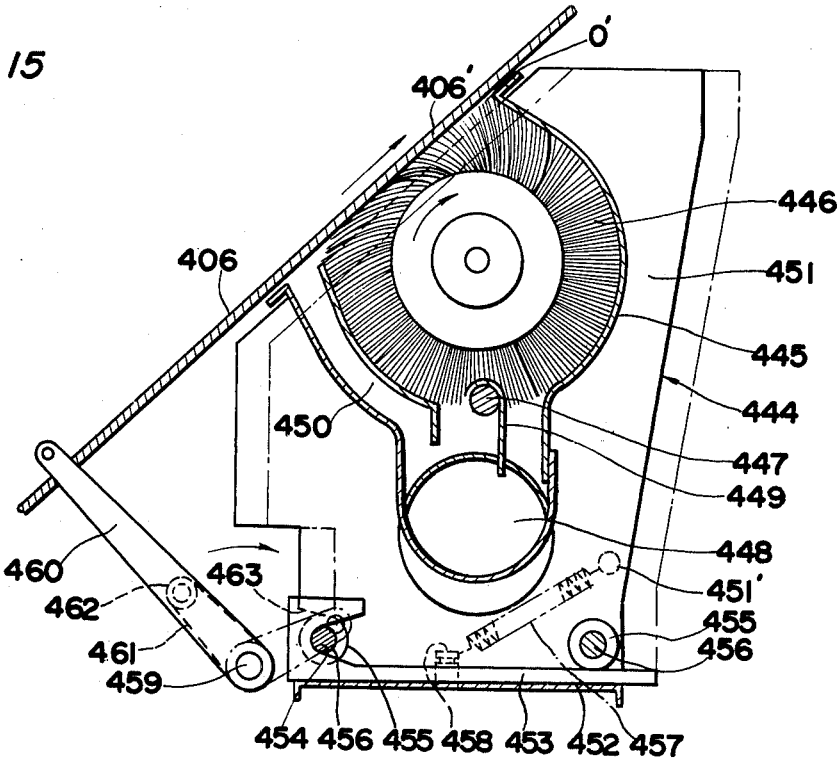
Figure 14:
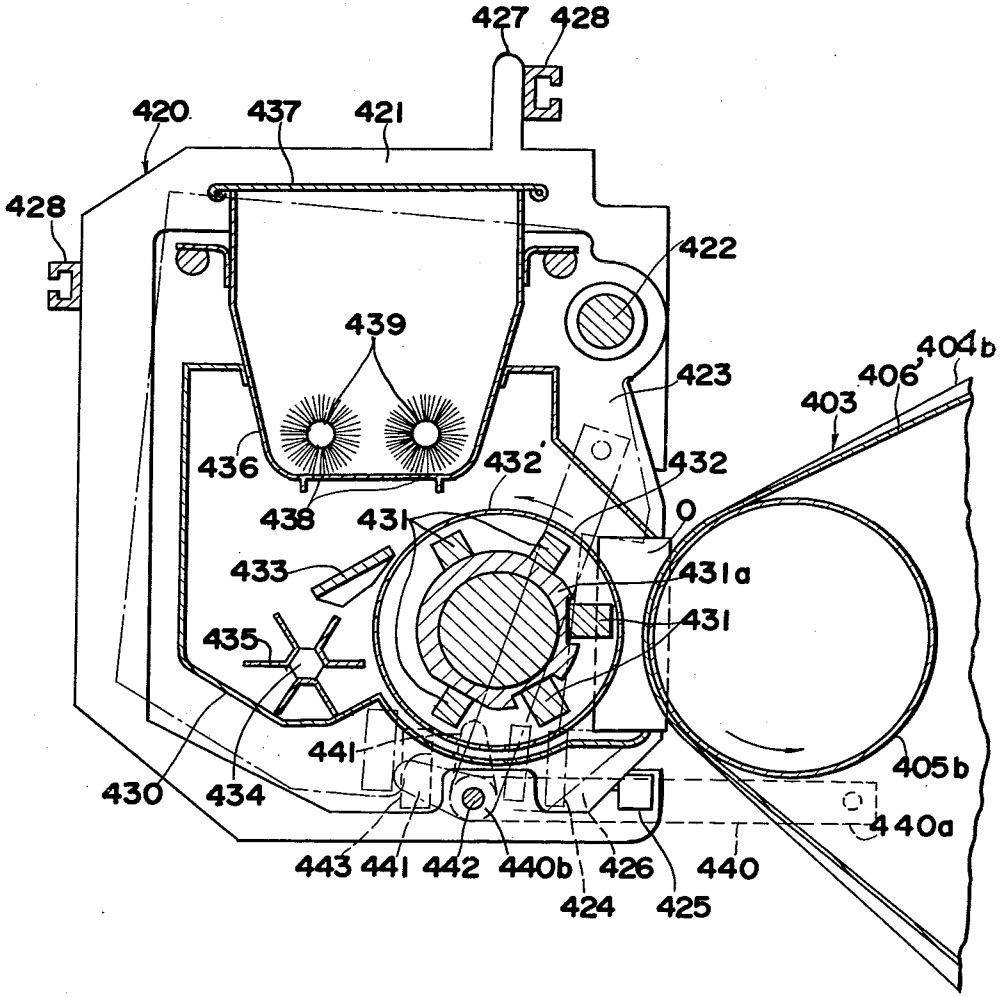
Figure 13:
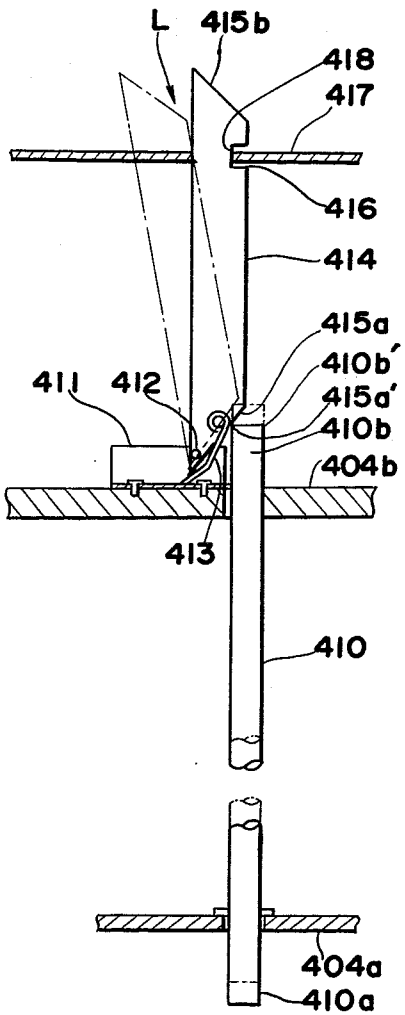
Figure 17:
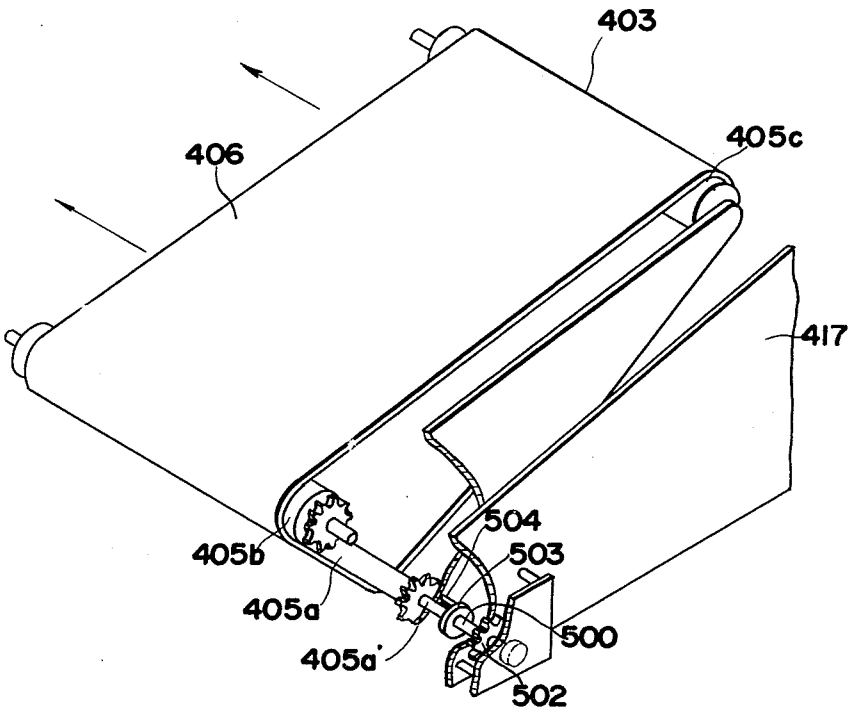
Figure 16:
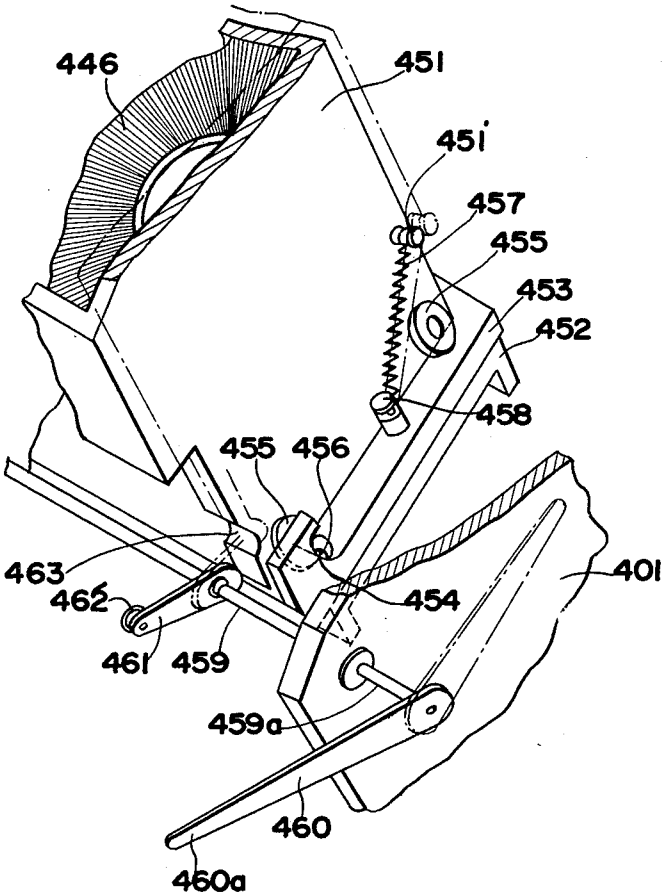
Figure 18:
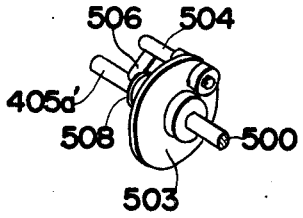
Figure 18:
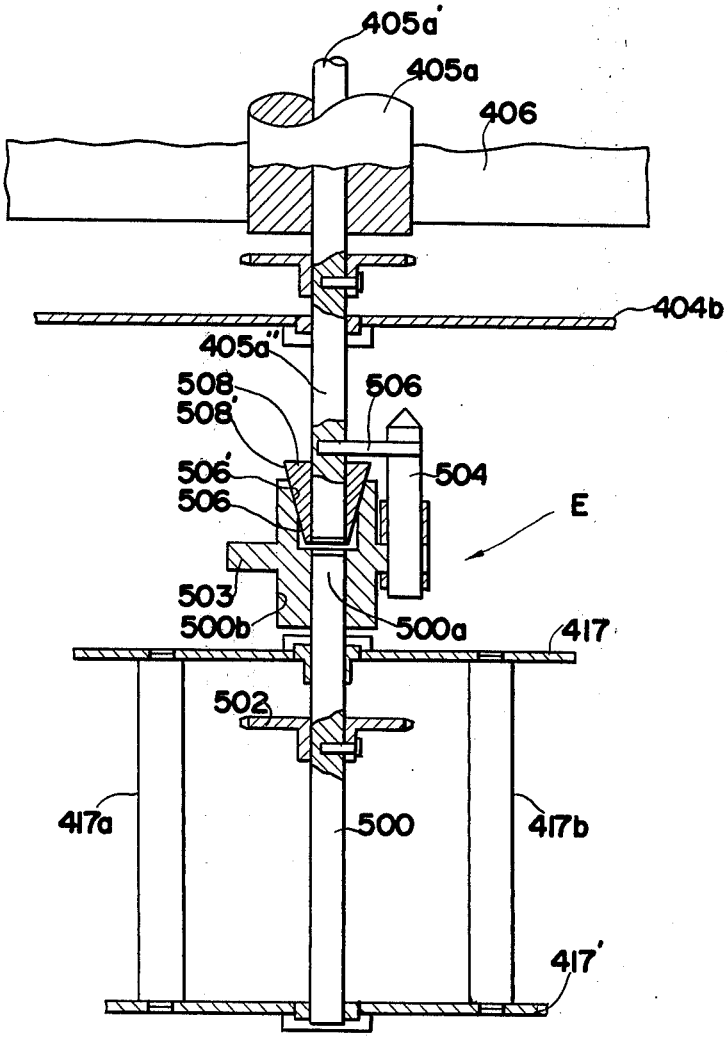

FIG. 3 is a top plan view, on an enlarged scale, of a charge eraser and a corona charger employed in the apparatus of FIG. 1, FIG. 4 is a sectional view, on a enlarged scale, taken along the line I—I in FIG. 3, FIG. 5 is a sectional side view, on an enlarged scale, of an important part of the electrophotographic copying apparatus of FIG. 1, FIG. 6 is a sectional side view of a modification of the copying apparatus of FIG. 1, FIG. 7 is a sectional side view, on an enlarged scale, of an important part of the modification in FIG. 6, FIG. 8 is a sectional side view, on an enlarged scale, of a modification of a roll copy paper section for a copy paper feeding device employed in the copying apparatus of FIG. 1, FIG. 9 is a top plan view of the modification of FIG. 8;

FIG. 10 is a sectional side view, on an enlarged scale, of a fixing device employed in the copying apparatus of FIG. 1, FIG. 11 is a sectional view taken along the line II—II in FIG. 10 with a heat shielding device, corona chargers and belt means removed, FIG. 12 is a partly broken away, sectional side view of a modification of the apparatus of FIG. 1, FIG. 13 is a top plan view, on an enlarged scale and partly in section, of a locking mechanism employed in the modification of FIG. 12, FIG. 14 is a cross sectional side view, on an enlarged scale, of a developing device employed in the modification of FIG. 12, FIG. 15 is a cross sectional side view, on an enlarged scale, of a residual toner removing device employed in the modification of FIG. 12, FIG. 16 is a perspective view of the residual toner removing device of FIG. 15, FIG. 17 is a perspective view showing a photoreceptor unit and associated mechanisms employed in the modification of FIG. 12, FIG. 18 is a top plan view, on an enlarged scale and partly in section, of an engaging mechanism employed in the modification of FIG. 12, FIG. 18*a* is a perspective view of the mechanism of FIG. 18.

Figure 19:
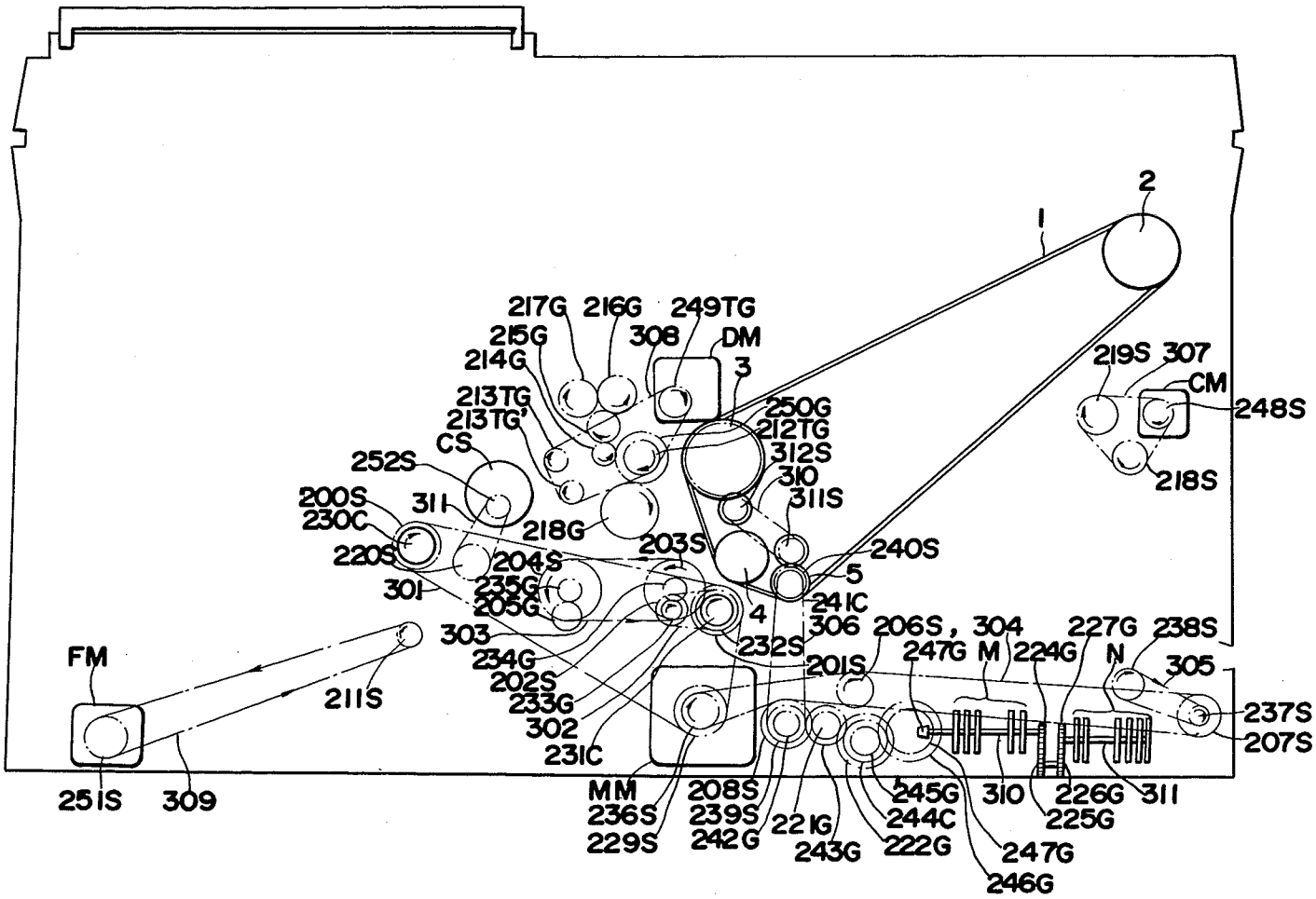
Figure 20:
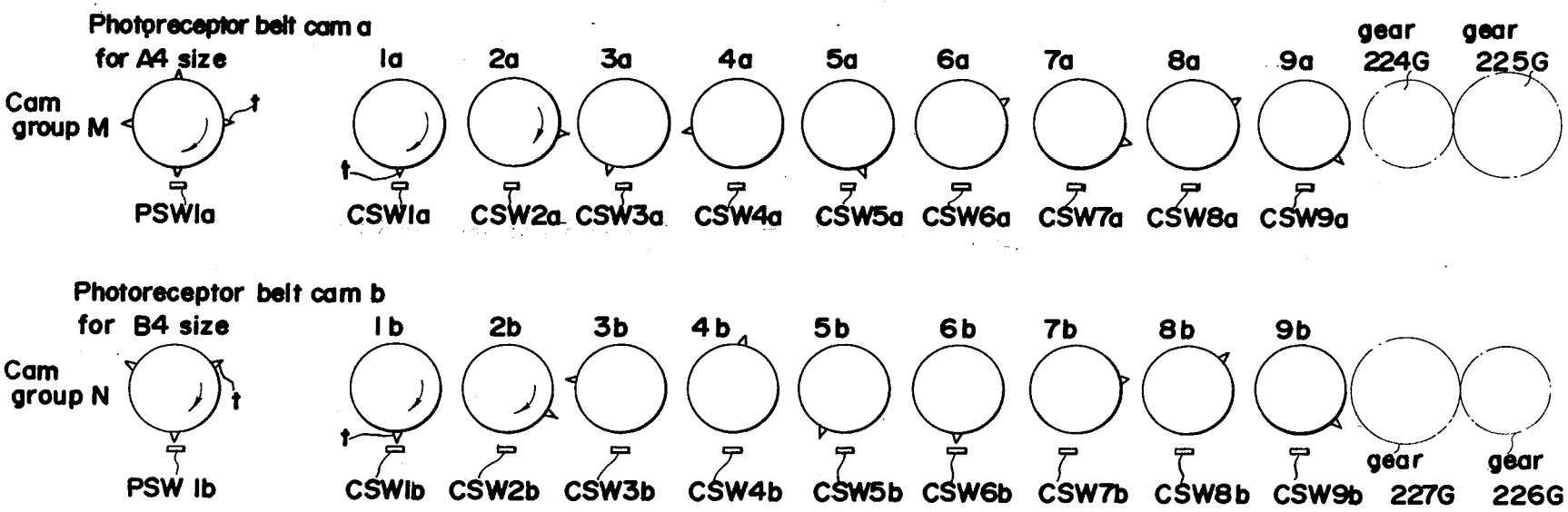
Figure 21:
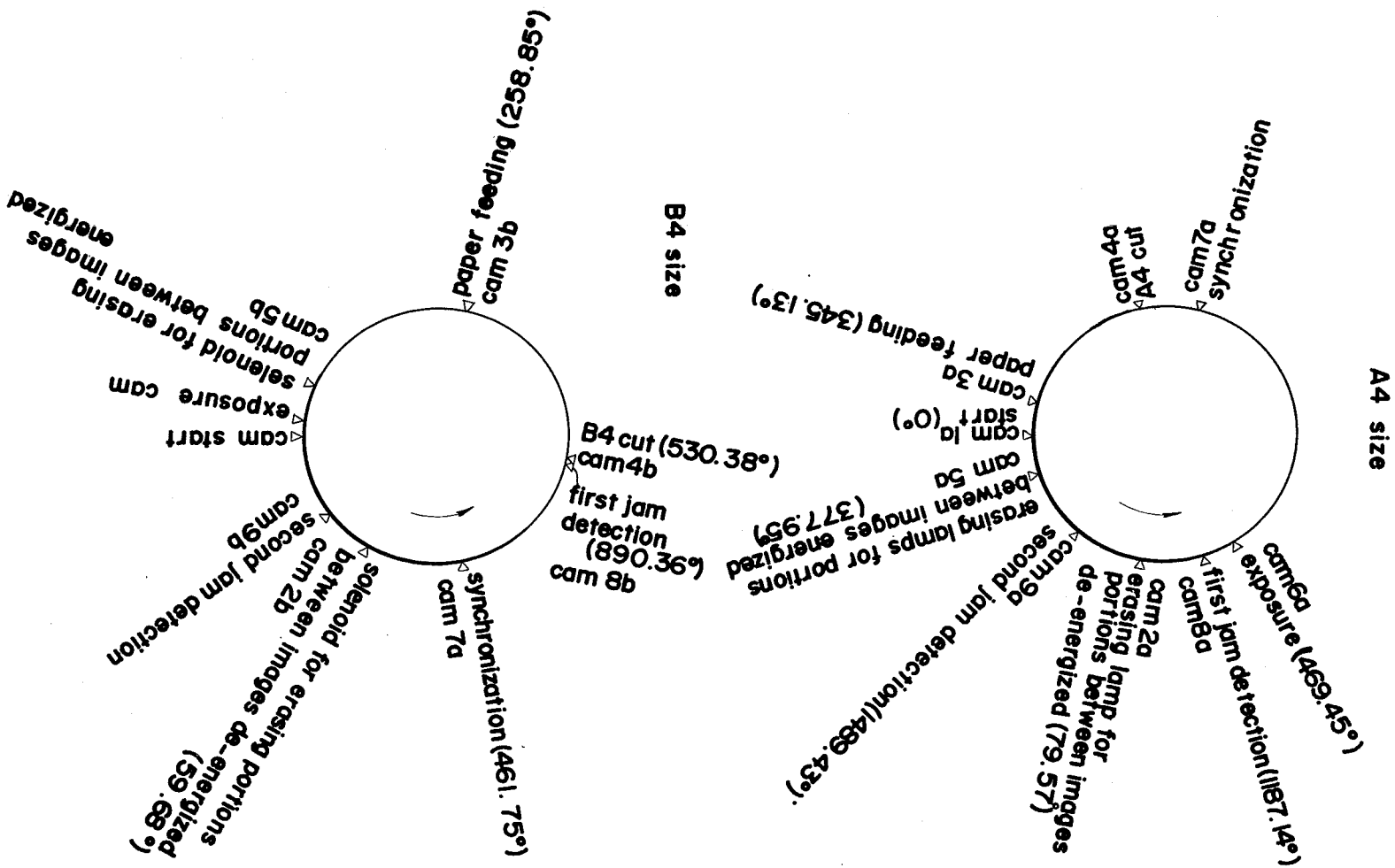
Figure 22:
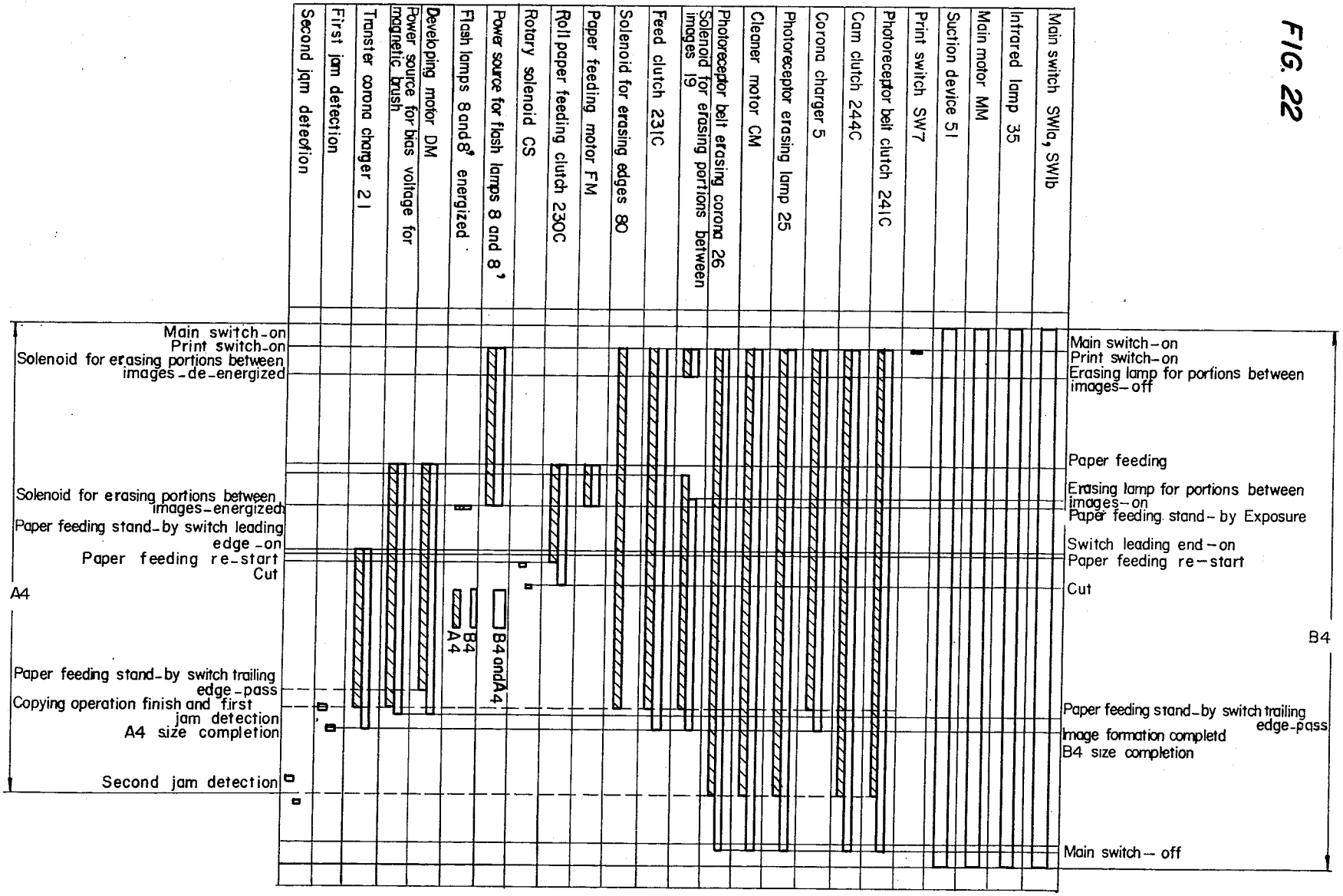
Figure 23:
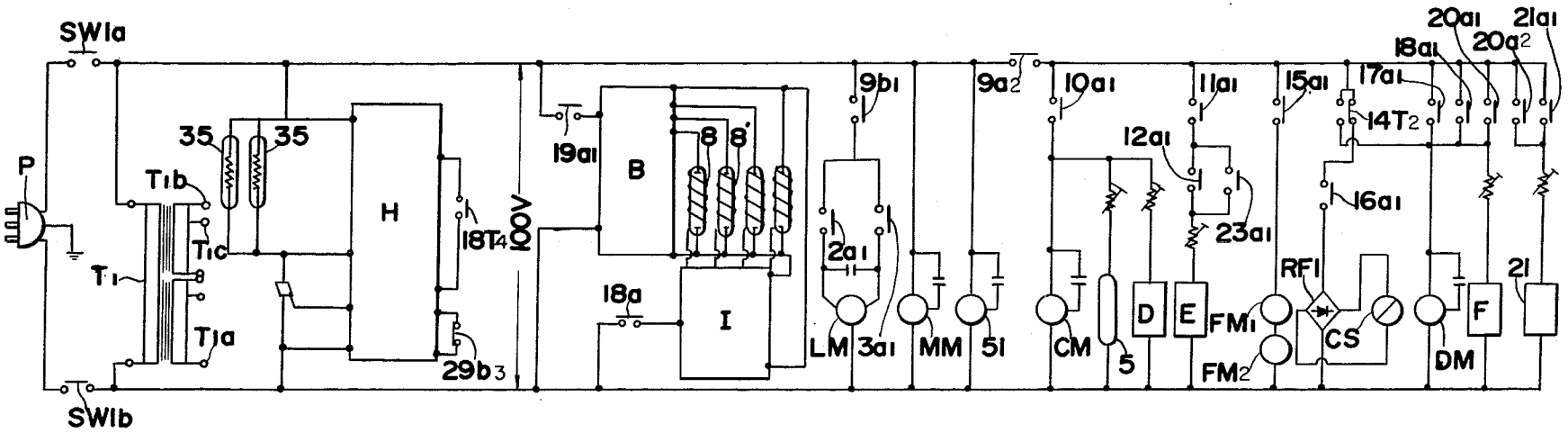

FIG. 19 is a view similar to FIG. 1, but particularly showing a driving mechanism thereof, FIG. 20 is a schematic diagram showing the arrangement of cam plates for A4 and B4 size copying of the copying apparatus in FIG. 1, FIG. 21 is a diagram showing the sequence of operation of the copying apparatus of FIG. 1, FIG. 22 is a timing chart showing the sequence of operation of the copying apparatus of FIG. 1, FIGS. 23 through to 26 are schematic electrical diagrams showing arrangements of various elements of the copying apparatus of FIG. 1, and FIG. 27 is a schematic diagram showing the sequence of operation of the cams of the copying apparatus of FIG. 1.

Before the description of the present invention proceeds, it is to be noted that like parts are designated by like numerals throughout several views of the accompanying drawings.

Referring to FIG. 1, the electrophotographic copying apparatus of the invention comprises an electrophotosensitive web or belt 1 having a photoconductive photoreceptor surface 1' on a conductive backing and directed, for continuous movement in the direction of an arrow X, around two idle rollers 2 and 4, a follower roller 3, and a driving roller 5 having parallel axes so as to cause the photoreceptor surface 1' to sequentially pass a plurality of processing stations, such as a charging station with a corona charger CC, an exposure station 6, a developing station having a developing device 15, a transfer station provided with a transfer corona discharger 21, a charge erasing station 24 and a cleaning station provided with a residual toner removing device 27, each of which is disposed along a path of a photoreceptor surface 1' having four flat surfaces 1*a*, 1*b*, 1*b'* and 1*c* between the neighboring rollers 2, 3, 4 and 5, a transparent platform 7 to place an original Or to be copied thereon which is fixedly supported at an upper portion of the apparatus housing T, a platform cover 7*a* pivotally secured in position to cover the platform 7, a pair of linear light sources 8 and 8' for illuminating the original Or which are provided below and adjacent to said platform 7, an optical system F disposed between the platform 7 and the flat surfaces 1*a* of the photoreceptor 1' for directing image rays of the original Or onto the exposure position 6 on the surface 1*a* for forming an electrostatic latent image thereon.

The photoreceptor belt 1 further comprises a flexible polyester film base such as "Mylar" of approximately 100¾ thickness containing an electrically insulating material, on which film base layers of Al, Se, PVK (polyvinyl carbazole) etc., are deposited one after another with opposite ends of the belt 1 suitably joined at a seam or joint 1*j* to form the endless photoreceptor belt 1.

Referring to FIG. 2, the belt 1 is so arranged, along its entire length, as to be divided into four equal latent image forming parts A4′ for A4 size copies and into three equal latent image forming parts B4′ for B4 size copies and is adapted to complete one copying operation in 5/4 of a turn, for the A4 size and at 4/3 turn for B4 size in copying a single copy paper sheet. Accordingly, in single sheet copying for both A4 and B4 sizes, the latent image is formed on a different portion of the photoreceptor surface 1′ in each copying operation, by which arrangement, fatigue or deterioration of a specific portion of the surface 1′ can be advantageously prevented.

On the contrary, in continuous copying on many sheets of copy paper, the three or four equally divided latent image forming portions A4′ or B4′ on the surface 1′ are sequentially subjected to monentary exposure for providing three or more copies continuously per one revolution of the belt 1′.

Furthermore, the seam 1*j* or each of the non-image containing positions *a*, *b* and *c*, or I and II between the image containing portions A4 or B4 on the photoreceptor belt 1 is arranged to be positioned at a predetermined position, for example, a datum position J (FIG. 1) located in a position prior to the corona charger CC described later so that the seam 1*j* or the portions, *a*, *b* and *c* or I and II will not be positioned at any other positions than the datum position J during formation of the latent image. Similarly, in switching over from making A4 size copies to B4 size copies or vice versa, the seam 1*j* or one of the portions *a*, *b*, and *c* or I and II is adapted to be positioned at the datum position J. In other words, for switching over from making A4 size copies to B4 size copies, the non-image carrying portions *a*, *b* or *c* between the image carrying portions A4′ located at the datum position J is transferred to the non-image carrying portions I or II or seam 1*j*, while for switching over from B4 size copies to A4 size, the non-image carrying portion I or II between the image carrying portions B4′ is shifted to the non-image carrying portion b or c between the image carrying portions A4′ by a preliminary movement of the belt 1, in which case, however, if the seam 1*j* of the belt 1 is located at the datum position J, such a preliminary movement of the belt 1 is not necessary.

Referring back to FIG. 1, air suction plates 55 and 56, each extending approximately the entire length of the flat portion 1*a* or 1*c* of the photoreceptor belt 1 are provided adjacent to the back surfaces of the flat portions 1*a* and 1*c* so that the former are in sliding contact with the latter as the photoreceptor belt 1 rotates. The suction plates 55 and 56 are connected with a suction device 51 described later through a duct (not shown) for attracting the belt 1 toward the suction device 51 during the copying operation so as to maintain the portions 1*a* including the exposure position 6 and 1*c* provided with the charge erasing station 24 and the cleaning station 27 uniformly flat. Anothe flat plate 57 is disposed close to the back surface of the portion 1*b* of the belt 1, which plate 57, however, is not connected with the suction device 51, since the portion 1*b* is maintained sufficiently flat by the plate 57 alone because of the presence of the follower roller 3 and the idel roller 4 disposed close to each other. To the sliding surfaces of the plates 55, 56 and 57, are adhered tapes (not shown) comprising an electrically insulating material, for example, "Mylar" as in the flexible film for the photoreceptor belt 1, which tapes are effective for preventing frictional charging as the belt 1 slides along the surfaces of the plates 55, 56 and 57, thus eliminating inconveniences due to electrostatic attraction such as an increase of load in driving the belt 1, damage to the photoreceptor surface 1′ by a spark discharge, difficulty in moving the belt 1′ manually for replacing the same, etc.

The transparent platform 7 fixed horizontally at the upper portion of the apparatus housing T is provided with a cover plate 7*a* pivotally secured in position for covering and forcing the original Or to be copied into intimate contact with the platform 7. The platform cover 7*a* is provided with depending portion 7*b* at the side edges thereof for preventing the illuminating light from coming through the cover 7*a* during exposure. One side edge of the transparent platform 7 is adapted to project outwardly from the apparatus housing T to a certain extend to form a projecting portion (not shown) with one side edge of the cover 7*a* having a notch (not shown) facing the above mentioned projecting portion of the platform 7 so that when the original Or to be copied is too long to be covered by the cover 7*a*, part of the original Or can be extended through the notch formed in the cover 7*a* for efficient copying.

The linear light sources 8 and 8′ disposed below and adjacent to the platform 7 for total exposure of the original Or are, for example, flash discharge lamps.

The optical system F comprises a mirror 9 fixedly disposed below the platform 7 and suitably inclined to direct the image rays from the original Or to a mirror 10 through a lens 11 or 12, which mirror 10 in turn directs the image rays onto the exposure postion 6 on the photoreceptor surface 1*a* of the the belt 1 to form the latent image of the original Or thereon. The lenses 11 and 12 with different magnification are slidably supported by two supporting arms (not shown) provided in a position normal to the horizontal axis of the apparatus housing T so as to be alternatively disposed on the optical axis for suitably changing the amount of reduction of the size of the original images to be copied.

Needless to say, more than two of such lenses may be employed for obtaining various reduction for the copying of the original Or.

Exposure width control means 13 disposed between the lower edge of the mirror 10 and the exposure position 6 on the photoreceptor surface 1*a* includes a solenoid valve 14*a* and a light shielding plate 14*b* associated therewith, with the shielding plate 14*b* adapted to be turned to a position shown by the dotted line in FIG. 1 by the action of the solenoid 14*a* when the original Or is a B4 size and with the plate 14*b* being returned to the original full line position upon de-energization of the solenoid 14*a* when copying on original Or of an A4 size so that the exposure position 6 of the surface 1*a* will not be exposed more than necessary for the A4 size. The shielding plate 14*b* is actuated through energization of the solenoid 14*a* by pressing a copying size selecting button (not shown) disposed on a control panel (not shown) mounted on an upper from portion of the apparatus housing T.

Referring also to FIGS. 3 and 4, the corona charger CC extending across the width of the photoreceptor belt 1 is disposed between the exposure width control means 13 and the exposure position 6 on the surface 1*a* in a position immediately before the exposure position 6 close to the idle roller 2 for negatively charging the entire surface of the photoreceptor 1'. A charge eraser 28 for controlling the charged area disposed adjacent to and at the left of the corona charger CC is for erasing the charge in the non-image carrying portions *d* and *d'* at the side edges of the image carrying portions A4' and also the portions *a*, *b* and *c* or I and II between the image carrying portions A4' or B4' (FIG. 2).

The charge eraser 28 includes a lamp housing 71 in which an erasing lamp 72 in the form of a straight fluorescent lamp extending approximately the width of the photoreceptor surface 1' is enclosed, an elongated slit 73 formed below the lamp 72 at the bottom portion of the housing 71 in a direction parallel to the lamp 72, and a light guide 74 with good light transmittance composed, for example, of acrylic resin, which guide 74 extends downward from the slit 73 to a position close to the photoreceptor surface 1' for erasing the charge on the non-image carrying portions on the photoreceptor surface 1'. The slit 73 is provided with a light shielding shutter plate 81 which is adapted to move to open or close the slit 73 in association with solenoids 79 and 80 through a wire 75 one end of which is connected to the plate 81 and which is directed around pulleys 76, 77 and 78. The shutter plate 81 is provided with a portion 82 of approximately the same width as the image carrying portion A4' for erasing charge on the non-image carrying portions *d* and *d'* (FIG. 2) at the side edges of the image carrying portions A4' for the A4 size, and a portion 83 of approximately the same length as the slit 73 for erasing the charge at the none-image carrying portions *a*, *b* and *c* or I and II between the image carrying portions A4' or B4' (FIG. 2) with the portion 82 projecting from the portion 83 to a certain extent in a top plan view of the plate 81. The shutter plate 81 is normally urged in a direction shown by an arrow s by a pair of springs 85 stretched between opposite ends of the plate 81 and corresponding pins 84 fixed on the lamp housing 71 so as to close the slit 73. A pair of shutter guide plates 87 having hinges 88 fixes to the upper portions of the plate 87 are fixed, for pivotal movement, to pins 86 rotatably received in an elongated opening 86' formed in brackets located below the shutter plate 81 with the hinges 88 fixed to the under surface of the shutter plate 81 for guiding the plate 81 accurately without any zigzag movement.

In this arrangement, when the copies to be made are A4 size, the solenoid 79 of the charge eraser 28 is energized by a signal from suitable control means so as to rotate pulley 77 in a direction to wind the wire 75 with consequent movement of the shutter plate 81 to such a position that only the portion 82 of the shutter plate 81 for erasing the charge on the non-image carrying portions *d* and *d'* at the side edges of the image carrying portions A4' covers the slit 73. Accordingly, the portions at the ends of the slit 73 corresponding to the non-image carrying portions *d* and *d'* are left open with the charge at the portions *d* and *d'* erased by light rays from the erasing lamp 72. Then, when the image carrying portions a, *b* and *c* of the belt 1 pass immediately under the light guide 74, another solinoid 80 is actuated, turning the pulley 78 for winding the wire further so as to bring the shutter plate 81 to a position shown in the dotted line in FIG. 4 in which case the slit 73 is fully open for continuously erasing the charge on the non-image carrying portions *d* and *d'* and also for erasing the charge on the non-image carrying portions *a*, *b* and *c*. When making B4 size copies. since the width of each of the image carrying portions B4' is approximately equal to the width of the photoreceptor belt 1, charge erasing at the side edges of the image carrying portions B4 ' is not necessary, so that the shutter plate 81 is adapted to move to fully open the slit 73 when the non-image carrying portions I and II pass under the slit 73 for erasing the charge on the portions I and II.

As described above, by erasing the charge on the non-image carrying portions *a*, *b* and *c*, *d* and *d'* or I and II in advance by means of the charge eraser 28, such non-image carrying portions are not developed and unnecessary waste of toner powder is advantageously prevented with consequent reduction of the working load for the residual toner removing device 27.

It is to be noted here that the charge erasing lamp 72 described as employed in the above embodiment may be replaced by an equivalent corona discharger.

Referring to FIG. 5, the magnetic brush developing device 15 disposed adjacent to a portion of the photoreceptor surface 1' supported by the roller 3 mainly includes a developing roller 18 rotatably provided in a housing 15 ' close to the photoreceptor surface 1' and exposed thereto through an opening g of the housing 15' and comprising a rotatable outer cylinder 18*a* and three stationary magnets 17 fixedly disposed, at approximately right angles to one another, on a stationary shaft 16 enclosed in the outer cylinder 18*a* with alternately different polar orientation, and a toner dispenser 19 mounted on the housing 15'. As the outer cylinder 18 *a* rotates in the direction of the arrow Y, magnetic brush bristles formed by developing material on the periphery of the cylinder 18*a* contact the photoreceptor surface 1' moving in the direction of the arrow X to develop the latent image of the original Or formed on the surface 1' at the exposure position 6 a visible toner powder image. A stirring vane 18*b* for stirring the developing material is rotatably provided at the left of the cylinder 18*a*, while a scraping plate 18*c* for scraping residual developing material off the cylinder 18*a* which is in sliding contact with the periphery of the cylinder 18*a* is provided above the stirring vane 18*b*. The developing device 15 is further provided with a stirring vane 18*d* rotatably disposed below the stirring vane 18*b*, a bucket conveyor 18*e* for carrying a fixed amount of toner powder onto the outer cylinder 18*a* which conveyor 18*e* rotatably provided below the cylinder 18*a*, a regulating plate 18*f* for adjusting the height of the brush bristles formed on the cylinder 18*a* and a toner powder receiving box 18*g* releasably provided in a position below the cylinder 18*a* for receiving toner powder which tends to fall out of the device 15 when the magnetic brush bristles formed on the outer cylinder 18*a* contact the photoreceptor surface 1'. The stirring vane 18*b* is to stir and sufficiently mix fresh toner powder from the toner dispenser 19 with the toner particles scraped off the outer periphery of the cylinder 18*a* by the scraping plate 18*c* and to supply the same to the stirring vane 18*d* disposed therebelow for further stirring, from which vane 18*d* the toner powder is supplied onto the bucket conveyor 18*e* suitable for feeding a predetermined amount of toner powder to the outer cylinder 18*a*.

The toner dispenser 19 provided on the upper part of the developer housing 15' comprises a toner tank 20 having therein a pair of spiral brushes 20*a* rotatably provided at the lower portion of the tank 20 with the brush bristles of the brushes 20*a* being in sliding contact with the bottom portion of the tank 20 and with slits 20*b* for supplying toner powder in the bottom portion of the tank 20, so that upon rotation of the brushes 20*a*, the toner powder is adapted to fall into the housing 15' through the slits 20*b*. The smount of the toner powder to be supplied is adjusted by varying the speed of rotation of the brushes 20*a*.

An air duct 29 (only an suction hole thereof is shown) which is communicated with the suction plates 55 and 56 for the belt 1 is disposed adjacent to the developing device 15 for collecting developing material scattering through a gap between the developing device 15 and the belt 1 so as to prevent such developing material from adhering to the reflecting mirror 10 and other parts.

It should be noted here that a similar air duct may be provided below the developing device 15 for collecting the falling toner particles instead of the toner powder receiving box 18*g* described as employed in the above embodiment.

The transfer corona discharger 21 is disposed in a position facing the flat portion 1*b'* of the belt 1' formed between the idle roller 4 and the driving roller 5. The flat portion 1*b'* (FIG. 5) is arranged to be at a small angle to a path C' of the sheet of copy paper C so that the path C' and the portion 1*b'* are in approximately a straight line, with the idle roller 4 disposed between the follower roller 3 and the driving roller 5. By disposing the flat surface 1*b'* 1 for transfer approximately in parallel with the path C' of the copy paper C as described above, the copy paper C can be transported efficiently without any inconveniences such as paper jamming, and moreover, since the copy paper C is smoothly attracted electrostatically to the surface *1b'*, excellent copied images can be obtained on the entire surface of the copy paper. Furthermore, as the transfer is carried out on the flat surface 1*b'*, a wide area is utilized for the transfer operation, thus contributing much to high speed copying.

Separation of he copy paper, for example, the copy paper C, from the belt 1' after transfer is mainly effected at a rather acutely curved portion of the belt 1' formed by the driving roller 5 by the resilience of the copy paper and an air flow from blower means provided in a fixing device 34 described later. In other words, the copy paper C fed from a copy paper feeding device A (FIG. 1) and electrostatically attracted onto the surface 1*b'* during transportation begins to have the leading edge thereof separated from the belt 1 by the tendency of the sheet C to move along a straight line and the presence of the acutely curved portion of the belt 1, and is subsequently peeled off the photoreceptor surface 1' of the belt 1 by the resilience of the sheet C itself while being blown by the air flow from the blower means in the fixing device 34, and it is then fed into the fixing device 34 through by guide plates 22, a comveyor belt 23 movably suspended by rollers 23*a*, 23*b* and 23*c* and provided with a suction device 23', and a feeding roller 22'.

It should be noted here that the idle roller 4 described as employed between the follower roller 3 and the driving roller 5 in the above embodiment may be dispensed with as shown in the modification of the above embodiment shown in FIGS. 6 and 7, in which case the positions of the idle roller 2, the follower roller 3 and the driving roller 5 ate slightly altered so that the belt 1 is disposed in the form of a triangle for obtaining similar transfer and separation results as in the embodiment in FIG. 1 having the idle roller 4.

In the above embodiment of FIG. 1, the transfer corona discharger 21 employed is a d. c. type exclusively contributing to the transfer by imparting to the sheet C a charge (negative charge in the above case) with opposite polarity to the toner powder image for strong electrostatic attraction. Since the electrostatic attraction described above may effect adversely the separation of the copy paper sheet C to a certain extend, it is desirable to neutralize the charge imparted to the back surface of the sheet C. For this purpose, the corona discharger 21 of d. c. type may be replaced by an a.c. half-wave rectifier having a small leak resistance connected thereto which imparts a negative charge cycle for transfer and a positive charge cycle for neutralization of the negative charge alternately to the copy paper C, thus erasing the charge on the sheet C during transfer for easy separation.

Referring back to FIG. 1 the charge erasing station 24 which faces the flat portion 1*c* of the belt 1 between the driving roller 5 and the idle roller 2 includes a corona discharger 25 for neutralizing the residual charge on the belt 1 after transfer and an eraser lamp 26 for electrically releasing the residual toner particles remaining on the belt 1.

The residual toner removing device 27 disposed subsequent to the charge erasing station 24 includes a cleaner brush 27*b* rotatable in the direction of the arrow Z in a housing 27*a* having an opening facing the flat surface 1*c* of the belt 1. Toner particles adhering to the brush 27*b* as it rubs against the surface 1*c* are detached from the brush 27*b* when the latter strikes against a flicker rod 27*c*, which detached toner particles are sucked into the suction device 51 (not shown) through the duct 27*d* with an air flow regulating plate 27*e* integrally formed with the flicker rod 27*c* and with a passage 27*f* formed between the brush 27*b* and the housing 27*a* for efficiently directing the flow of the detached toner particles into the duct 27*d*.

The copy paper feeding device A provided at the left lower portion of the apparatus T in FIG. 1 comprises a roll copy paper section 101, a cut copy paper sheet section 123 and a transportation belt assembly 150 for selectively feeding copying paper from a paper roll R provided in the section 101 or from a stack of sheets of copy paper in the section 123.

Referring also to FIG. 5, in feeding copy paper from the roll R rotatably supported at the axis 31 thereof by a pair of supporting member mentioned later, a web R' of copy paper from the roll R is fed into the belt assembly 150 including belts 150*a*, 150*b* and 150*c*, each movably supported by a plurality of rollers, through a pair of rollers 120 and 120' and simultaneously cut into a predetermined size by rotary cutter means 121 actuated in synchronization with the rotation of the rollers 120 and 120'.

On the other hand, in paper feeding from the stack of cut sheet of copy paper in the section 123, the sheet of copy paper sheet C is fed, one by one, from the top of the stack between the belts 150*b* and 150*c* through the roller 139 (FIG. 1).

The belt 150*b* is provided with a microswitch MS1 with an actuator MS1' thereof disposed in the path C' of the paper for detecting the leading edge of the paper web R' from the roll R or of the sheet of copy paper C and for feeding the copy paper to the transfer position 1*b'* in syncronization with the movement of the belt 1.

Referring now to FIGS. 8 and 9, there is shown a modification of the roll copy paper section 101 for the copy paper feeding device A of FIG. 1. In this modification, the construction of the roll copy paper section 101' is the same as the embodiment as briefly described above except that another pair of rollers 122' and 122 is provided subsequent to the cutter means 121.

In the roll copy paper section 101', there is provided a transversely extending box-like base plate 102 having a rectangular opening H formed in the upper surface thereof in a direction parallel to the width of the paper roll R with the middle portions of the long side edges of the rectangular opening H slightly extended downward to form positioning plates 30 and 30' facing each other for positioning the paper roll R. A pair of side plates 108 and 109 disposed in a direction normal to the surface of the plate 102 in spaced relation to each other are slidably received in the base plate 102 at the base portions 108' and 109' thereof in positions adjacent to opposite side walls of the base plate 102 with the side plates 108 and 109 movably connected at the base portions 108' and 109' thereof to three transversely extending shafts 105, 106 and 107. A knob 104 is fixed to one end of the shaft 105 which is rotatably received in a bore formed in the base portion 108' of the plate 108 with the axial movement of the shaft 105 limited by the plate 108, while the other end of the shaft 105 is threaded to provide a threaded end 105*a* which is threadedly connected to the base portion 109' of the plate 109. On the other hand, one end of the shaft 106 is threaded to provide a threaded potion 106*a* which is threadedly connected to the base portion 108' of the side plate 108 while the other end of the shaft 106 is rotatably received in a bore formed in the base portion 109' of the plate 109 with the axial movement of the shaft 106 limited by the plate 109. A gear 110 fixedly mounted on the middle portion of the shaft 105 is adaped to mesh with a gear 111 also fixedly mounted on the corresponding portion of the shaft 106, so that, upon rotation of the knob 104 in a direction, for example, of the arrow S, the rotation of the shaft 105 is transmitted to the shaft 106 through the gears 110 and 111 with the shaft 10 rotated in the direction of the arrow S' and with the side plates 108 and 109 being moved inwardly toward each other. In order to move the plates 108 and 109 outwardly away from each other, the knob is turned in the opposite direction to that shown by the arrow S.

A shaft 113 having a knob 113' at one end thereof is slidably received in a hub 116 fixed to the upper portion of the side plate 108 with the axis of the shaft 13 in parallel with the axes of the shaft 105 and 106, and a supporting member 114 in the shape of a truncated cone is rotatably mounted at the other end of the shaft 13 on a bearing 113*b*. a pin 113*a* extending radially outwardly at right angles from the shaft 113 is adapted to engage a groove 117 having a notch 117*a* which is formed in the hub 116. By engaging the pin 113*a* with the notch 117*a* of the groove 117, the supporting member 114 projecting inwardly is axially positioned, while the member 114 can be withdrawn outwardly to a position shown by the chain line in FIG. 9 when the pin 113*a* is engaged with the groove 117 by the rotation of the knob 113' in the direction of the arrow T with subsequent pulling of the knob 113' outwardly. A shaft 112 fixedly mounted on the upper portion of the side plate 109 is axially in alignment with the shaft 113 and is provided with a supporting member 115 of a similar truncated cone shape rotatably mounted at the inner end of the shaft 112 on a bearing 112*a* with the members 114 and 115 facing each other.

A guide plate 118 inclined toward the feeding path C' of the copy paper is fixedly mounted on the base plate 102, and adjacent to the lower end 118' of the plate 118 is a lower feeding roller 120 having a knob 119 at one end thereof and above roller 120 is an upper feeding roller 120' comprising a plurality of resilient rollers mounted on a shaft 120*c* for rotation therewith. Roller 120' and the resilient rollers are synchronously rotatable with each other. Subsequent to the rollers 120 and 120' in the direction of paper feeding, a guide plate 118', the cutter means 121 operated by a rotary solenoid (not shown) and a pair of feeding rollers 112' and 122 are sequentially disposed along the paper path C'. A chain 122*c* is directed around a sprocket 120*b* fixed to a shaft 120*a* for the roller 120 and also around a sprocket 122*b* fixed to a shaft 122*a* of the roller 122. Accordingly, upon manual rotation of the knob 119, the rotation of the rollers 120 and 120' is transmitted through the chain 122*c* to the rollers 122 and 122' for the rotation of the latter.

Slide rails 103 snd 103' transversely extending and fixed to the opposite side walls of the base plate 102 are adapted to slidably engage corresponding guide rails (not shown) fixed to the frames of the apparatus housing T for inserting or withdrawing the roll paper section 101' into or from the housing T with the section 101' adapted to be connected with an electrical circuit and a driving source in the housing T described later and locked in the housing T.

For loading the roll paper R in the section 101', the section 101' is withdrawn from the housing T with the supporting member 114 moved back as described earlier, and the paper roll R is placed on the positioning plates 30 and 30' for approximate positioning, after which the member 114 is moved forward for inserting the front portions of the members 114 and 115 into a hollow paper tube 31 of the paper roll R to a certain extent so as to support the paper roll R therebetween. The leading edge of the web R' of paper from the roll R thus loaded is manually drawn from the roll R for insertion between the rollers 120 and 120' with subsequent rotation of the knob 119 in the direction of the arrow U for transporting the leading edge of the paper web R' from the roll R to the rollers 122 and 122'.

The side plates 108 and 109 are moved forward or backward by rotation of the knob 113' for minor adjustments of the positions of the supporting members 114 and 115 in loading the paper roll R or when a paper roll of different width is to be loaded.

Furthermore, a microswitch 147 is mounted on the base plate 102 in a position below the paper roll R for generating an empty signal when the paper roll R is used up and also for stopping all operation of the apparatus T.

Referring to FIGS. 10 and 11 the fixing device 34 disposed close to the transfer corona charger 21 (FIG. 1) and below the flat portion 1*c* of the belt 1 comprises an electrically insulated transporation belt 37 for the copy paper movably suspended by a pair of rollers 37*a* and 37*b*, corona chargers 38 and 39 disposed adjacent to the roller 37*a* in positions facing the surface of the belt 37 with the belt 37 therebetween, and a plurality of infrared lamps 35 disposed above the belt 37 and covered by a reflecting shade 36. The surface of the belt 37 is coated with insulating materials having good heat resistance such as Teflon and silicon rubber and is adapted to be charged with a specific polarity, for example, a positive charge, by the corona charger 38. The corona charger 39 is disposed above the belt 37 close to the inlet side 34*a* for the copy paper C coming into the fixing device 34 for charging the toner image carrying surface of the copy paper sheet C with a polarity opposite the charge by the corona charger 38, for example with a negative charge. A heat insulating member 41 is disposed above the reflecting shade 36 to cover the latter.

The copy paper C fed into the fixing device 34 through the inlet 34*a* is negatively charged by the corona charger 39 and is electrostatically attracted onto the surface of the belt 37 positively charged in advance by the corona charger 38 for being transported by the belt 37 and subsequently for being uniformly fixed by the infrared lamps 35. Upon completion of the fixing, the fixed copy paper sheet C is fed between transportation belts 81 and 82 (FIG. 1) each movably suspended by a pair of rollers through an outlet side 34*b* of the fixing device 34 and subsequently discharged from the apparatus T through an outlet 40 formed in the apparatus T.

Additionally, blower means 270 is disposed close to the inlet side 34*a* of the fixed device 34, which blower means 270 is adapted to send cooling air into the device 34 in case of emergency, such as paper jamming, and to direct a flow of air toward the earlier mentioned copy paper separating position on the flat portion 1*b'* of the photoreceptor belt 1 adjacent to the transfer corona charger 21 for assisting in the separation of the copy paper sheet C in the normal copying operation. The blower means 270 comprises an air duct 272 of rectangular cross section extending approximately the width of the fixing device 34 and disposed adjacent to and above the inlet side 34*a* for the copy paper sheet C, which duct 272 is connected with a fan 271 operated by a fan motor FM2 described later with a partition plate 273 for air flow extending approximately half way into the duct 272 fixedly provided in the duct 272 in a direction normal to the side walls 272*a* and 272*b* of the duct 272 so as to divide the air flow into two passages 276 and 277. Adjacent to one edge 273*a* of the partition plate 273, a shaft 274' which extends parallel with the edge 273*a* is rotatably supported by the side walls 272*a* and 272*b* of the duct 272 and an air flow regulating plate 275 is fixed to the portion of the shaft 274' between the side walls 272*a* and 272*b*. The shaft 274' extends through the side wall 272*b* to a certain extent, on which extended portion of the shaft 274' a gear 274 is fixedly mounted. The gear 274 engages, through an intermediate gear 279, with a main gear 278 which is associated for rotation with a solenoid HS, so that, in the normal copying operation, the air flow regulating plate 275 is located in a position to close the lower passage 276 of the duct 272 as shown by the full lines in FIG. 11. In this state, the air flow from the fan 271 is sent through the upper passage 277 and directed toward the copy paper sheet separating position in the direction shown by the arrow a through an opening 272*c* formed in the upper portion of the side wall 272*a* of the duct 272. Should the jamming of the copy paper occur the fixing device 34, in a second microswitch MS3 (FIG. 1) for jamming detection described later and provided close to the outlet side 34*b* of the fixing device 34 is not actuated by the passage of the copy paper sheet C during a predetermined period of time after a first microswitch MS2 for jamming detection provided in the vicinity of the inlet side 34*a* of the fixing device 34 is actuated, and a jamming detecting signal is sent to the solenoid HS which controls the rotation of the air flow regulating plate 275. Upon energization of the solenoid HS, the main gear 278 associated therewith is rotated and the plate 275 is rotated from the position closing the lower passage 276 to a position closing the upper passage 277 by the gears 279 and 274 and the shaft 274', by which the air flow from the fan 271 is sent into the lower passage 276 and directed toward the fixing device 34 onto the belt 37 through an opening 272*d* formed in the side wall 272*b* of the duct 272 for driving hot air in the device 34 toward the outlet side 34*b* so as to lower the temperature in the device 34.

A heat shielding device 50 disposed above the fixing device 34 between the flat portion 1*c* of the photoreceptor belt 1 and the fixing device 34 comprises a box like member 50' in which are provided many duct openings 52 connected, through a duct (not shown), to the suction device 51, for example, of a sirocco fan driven by a fan motor FM1 described later. Many suction holes 53 are formed in the bottom plate of the member 50' for absorbing heat from the fixing device 34. The air sucked in through the duct openings 52 described above acts in the same manner as in air curtain for efficiently shielding heat from the fixing device 34.

Referring now to FIGS. 12 to 16, there is shown a modification of the embodiment of FIG. 1. In this modification, the photorecptor belt 406 and rollers associated therewith are formed into a photoreceptor unit 403 which can be withdrawn from the apparatus housing T', in which case a developing device 420 and a residual toner removing device 444 adapted to be moved away from the photoreceptor unit 403 to avoid any damage to the photoreceptor surface 406' of a photoreceptor belt 406. A side plate 401 mountd at the front of the apparatus housing T' has an opening 402 corresponding to the shape of the photoreceptor unit 403, the developing device 420 and the residual toner removing device 444.

The photoreceptor unit 403 comprises a pair of triangular side plates 404*a* and 404*b*, between which the photoreceptor belt 406 is movably supported by a driving roller 405*a* and idle rollers 405*b* and 405*c* located with parallel axes at approximately the apexes of the triangular side plates 404*a* and 404*b*. A pair of channel shaped guide members 408 each transversely extending from the side plate 404*a* to 404*b* at positions adjacent to and below the driving roller 405*a* and the idle roller 405*c*, and secured on the corresponding brackets 407 fixed to the side plates 404*a* and 404*b*, are slidably engaged with a pair of corresponding guide rails 409 fixedly mounted on the edge of the opening 402. A locking mechanism L (FIG. 13) for securing the photoreceptor unit 403 to the apparatus T' includes a rod 410 which extends through the side plates 404*a* and 404*b* with one end 410*a* of the rod 410 projecting from the plate 404*a* and the other end 410*b* thereof also projecting from the plate 404*b* to a certain extent, and a lock plate 414 of a thin, long trapezoidal form cut at an angle at each end which is pivotally connected at one end 415*a* thereof to a bracket 411 secured to the side plate 404*b* by a pin 412 and urged clockwise in FIG. 13 by a spring plate 413. A notch 416 is formed in the lock plate 414 adjacent to the other end 415*b* thereof, which notch 416 is located in an opening 418 formed in a side wall 417 provided at the back of the apparatus T' with the notch 416 facing an edge of the opening 418, while the edge 415*a*' of the diagonally cut end 415*a* engages the end 410*b* of the rod 410 at the extreme tip 410' of the end 410*b*. The photoreceptor unit 403 when received in the apparatus housing T' in the normal operating condition is adapted to be locked with the notch 416 of the plate 414 engaging the edge of the opening 418 in the side wall 417. For releasing the locking of the unit 403, the end 410*a* of the rod 410 projecting form the plate 404*a* is manually pushed, in which case the tip 410*b*' of the rod 410 engaging the diagonally cut edge 415*a* of the lock plate 414 presses against the latter for rotating the plate 414 counterclockwise against the force of the spring 413 and consequently for disengaging the notch 416 from the edge of the opening 418. The side plate 404*a* is provided with a pair of handles 419 secured to the former for manually drawing out the unit 403.

Referring particularly to FIGS. 12 and 14, the developing device 420 disposed adjacent to the curved portion of the photoreceptor belt 406 supported by the idle roller 405*b* comprises a supporting plate 423 to which a developer housing 430 and a toner tank 436 are secured and which is pivotally connected by a pin 422 to a side wall 421 at the upper right portion of the wall 421 so as to be urged counterclockwise by the weight of the plate 423. The plate 423 is provided with a projection 424 fixed to the lower part thereof, which projection 424 is adapted to engage, for the positioning of the plate 423, the tip of a stop 426 secured to a bracket 425 fixed to the lower part of the side wall 421. A substantially L shaped lever 440 having a portion 441 extending upwardly at right angles from one end 440*b* thereof is pivotally connected, at the end 440*b* to the lower part of the side wall 421 by a pin 442 and is kept at the horizontal position shown by the dotted line in FIG. 14 in the normal operation of the apparatus T'. When the lever 440 is rotated counterclockwise about the pin 442 up to the position shown by the chain line in FIGS. 12 and 14, the portion 441 of the lever 440 depresses a projection 443 secured to the supporting plate 23 leftward and consequently the plate 23 is rotated clockwise about the pin 422 to the certain extent to a position shown by the chain line in FIGS. 12 and 14 for spacing the developing device 420 away from the photoreceptor unit 403 to a slight extent. The other end 440*a* of the lever 440 normally extends in front of the unit 403 to prevent the withdrawal of the unit 403, while, when the lever 440 is rotated up to the upright position as described above for spacing the device 420 away from the unit 403, the unit 403 is free for easy withdrawal. Furthermore, a pair of channel shaped guide members 428, secured on the upper left edge of the side wall 421 and on a projecting portion 427 at the upper right portion of the wall 421, are adapted to slidably engage a pair of guide rails 429 fixed to corresponding positions on the edge of the opening 402 formed in the supporting plate 401. In the housing 430 of the developing device 420, a developing roller 432 is rotatably provided adjacent to the photoreceptor surface 406' and is exposed thereto through an opening O formed in the housing 430. The roller 432 further comprises a rotatable outer cylinder 432' of a non-magnetizable material, five permanent magnets 431 fixedly disposed at a predetermined angles to one another on a fixed core 431*a* and enclosed in the outer cylinder 432', a scraping plate 433 for scraping residual toner powder off the surface of the cylinder 432' which plate 433 is in sliding contact with the cylinder 432', and stirring vane 435 fixedly mounted on a rotatable shaft 434 at a position below the plate 433. As the outer cylinder 432' rotates, magnetic bristles of developing material are formed for developing the latent image on the photoreceptor surface 406' into the visible toner powder image. The toner tank 436 provided above the developer housing 430 has a releasable cover plate 437 and a pair of slits 438 at the bottom portion of the tank 436 for toner particles to pass therethrough and has a pair of corresponding brushes 439 rotatably provided above the slits 438 for sliding contact with the slits 438.

The residual toner removing device 444 (FIGS. 15 and 16) for removing residual toner particles from the photoreceptor surface 406' includes a housing 445 having an opening O' adjacent to the surface 406', a cleaner brush 446 provided in the housing 445 so as to be rotatable clockwise, a flicker rod 447 for dislodging toner particles adhering to the cleaner brush 446, a duct 448 communicating with a suction device (not shown) for collecting the dislodged toner particles, an air flow regulating plate 449 integrally formed with the flicker rod 447 and a passage 450, which plate 449 and the passage 450 are adapted to control the flow of the detached toner particles for effectively collecting the same into the duct 448.

The function and operation of the above described developing device 420 and the residual toner removing device 444 are similar to those in the embodiment in FIG. 1, so that detailed description thereof is omitted for brevity.

A side wall 451 of the housing 448 of the residual toner removing device 444 has pair of guide wheels 455 rotatably mounted on corresponding pins 456 fixed at the lower portion of the wall 451, which wheels 455 are adapted to engage a guide rail 453 secured to a bracket 452 fixed on the lower edge of the opening 402 formed in the supporting plate 401, so that the device 444 can be moved leftward or rightward along the guide rail 453. The residual toner removing device 444 is normally urged leftward in FIG. 15 by a coil spring 457 stretched between a pin 451' fixed to the wall 451 and another pin 458 secured to the bracket 452 (FIGS. 15 and 16) with one of the pins 456 for the left side wheel 455 engaging a stop 454 which is formed at the left end of the guide rail 453 for positioning of the device 444.

A transversely extending shaft 459 is rotatably supported by the supporting plate 401 at a position adjacent to the stop 454 of the guide rail 453 with one end 459*a* of the shaft 459 projecting from the surface of the supporting plate 401 to a certain extent. A lever 460 is fixed to the shaft at right angles to the axis of the shaft 459 at the end 459*a*, while another lever 461 having a roller 462 at the end thereof is secured on the shaft 459 in a direction parallel to the lever 460 at a position adjacent to a semi-circular notch 463 formed in the side wall 451. Accordingly, upon rotation of the lever 460 clockwise in FIG. 16, the lever 461 turns simultaneously as shown by the chain line in FIG. 12, with the roller 462 engaging the semi-circular notch 463 for depressing the side plate 451 rightward (FIG. 15) with consequent movement of the side plate 51 to a position shown by the chain line along the guide rail 453 for spacing the device 444 from the unit 403. The free end 460*a* of the lever 460 is located in front of the unit 403 for preventing the withdrawal of the unit 403 in the normal operating condition, while the same is kept away from the front surface of the unit 403 when the device 444 is to be spaced away from the unit 444 for removal of the unit 403.

With this arrangement, for drawing out the photoreceptor unit 403 from the apparatus T' for maintenance or replacement, the lever 440 for the developing device 420 and the lever 460 for the residual toner removing device 444 are rotated as described above for spacing the devices 420 and 444 away from the unit 403, after which procedure the tip 410*a* of the rod 410 for the photoreceptor unit 403 is depressed for releasing the locking of the unit 403 and the unit 403 is manually drawn out of the apparatus housing T' by the handles 419. In the normal operating condition, since the levers 440 and 460 are present in front of the unit 403, the unit 403 can not be pulled out of the apparatus T' even if the rod 410 is depressed for unlocking. The unit 403 can be inserted into and set in the apparatus T' by merely sliding the unit 403 along the guide rails 409 into the apparatus T', since the diagonally cut edge 415*b* of the lock plate 414 slides along the edge of the opening 418 in the side wall 417 and subsequently the notch 416 of the plate 414 engages the edge of the opening 418 for locking the unit 403 in position.

Furthermore, the developing device 420 can also be drawn out of the apparatus T' for replenishing the same with fresh toner powder after the lever 440 has been rotated for spacing the device 420 from the unit 403. The device 420 can be set in the apparatus T' by sliding the device 420 along the rails 429 into the apparatus T' and subsequently returning the lever 440 to the original horizontal position. In other words, by rotating the lever 440 back to the original horizontal position, the supporting plate 423 to which the developer housing 430 is secured rotates counterclockwise by its own weight about the pin 422 with the projection 443 of the plate 423 subsequently engaging the tip of the stop 426 mounted on the side wall 421 for positioning the device 420.

In the modification as described above, since the photoreceptor unit 403 and the developing device 420 are adapted to be drawn out of the apparatus T', the driven shafts (not shown) of the unit 403 and the device 420 must be positively connected to corresponding driving shafts (not shown) provided in the apparatus T' when the unit 403 and device 420 are inserted and set therein with the axis of each driven shaft being in perfect alignment with that of the corresponding driving shaft of the apparatus T'. For this purpose, an engaging mechanism E is employed in the above modification, which will be described below with reference to FIGS. 17, 18 and 18*a* showing the engaging mechanism of the photoreceptor unit 403.

A driven shaft 405*a'* for the driving roller 405*a* of the photoreceptor unit 403 extends through the side plate 404*b* with the end 405*a''* thereof projecting from the plate 404*b* to a certain extent. An engaging member 508 having a truncated cone shape is fixedly mounted on the extreme tip of the end portion 405*a''* of the shaft 405*a'*, while a pin 506 radially, outwardly extending at right angles from the shaft 405*a* is fixedly mounted on the end portion 405*a''* adjacent to the member 508. On the other hand, a shaft 500 extends through and is rotatably supported by the side walls 417 and 417' of the apparatus T' with the axis of the shaft 500 being in alignment with the axis of the shaft 405*a'*. A sprocket 502 is fixedly mounted on the shaft 500 on a portion of the latter located between the side walls 417 and 417' for suitable connection to driving means (not shown). One end 500*a* of the shaft 500 facing the engaging member 508 of the shaft 405*a'* projects from the wall 417 to a position adjacent to the end portion 405*a''* of the shaft 405*a*. A receiving member 500*b* having a flange portion 503 therearound and a cone shaped bore 506 formed in the front portion thereof facing the engaging member 508 is fixedly mounted on the end portion 500*a* of the shaft 500, while a pin 504 extends through and is secured to the flange portion 503 of the member 500*b* in a direction parallel to the axis of the shaft 500. Accordingly, when the unit 403 is inserted into and set in the apparatus T', the truncated cone shaped engaging member 508 of the driven shaft 405*a'* for the unit 403 engages in the cone shaped bore 506 of the driving shaft 500 with the outer periphery 508' of the member 508 closely contacting the inner surface 506' of the bore 506 and with the axis of the shaft 405*a'* perfectly aligned with the axis of the shaft 500. During the copying operation, the driving force frosm the driving means (not shown) is transmitted to the shaft 405*a'* and the roller 405*a* for moving the photoreceptor belt 406 through the driving shaft 500 and the pins 504 and 506.

Although either the member 508 or the member 500*b* need be provided with the conical surface for line contact between the two members 508 and 500*b*, it is preferable that the both members 508 and 500*b* be provided with the conical surfaces for face contact between the two as described above, since very accurate positioning of the guide rails 409 (FIG. 12) for inserting the unit 403 is rather difficult the manufacturing of the copying apparatus, which may result in a deviation between the axes of the shafts 450*a'* and 500. Furthermore, in manufacturing the driving system, positioning of the shaft 500 is effected by first loosening the stay bolts 417*a* and 417*b* between the side walls 417 and 417', and after the positioning, the stay bolts 417*a* and 417*b* are tightened. Therefore, the conical surfaces provided on both the members 508 and 500*b* are effective for quick alignment of the axes of the shafts 405*a'* and 500*a* and also for accurate positioning of the shaft 500 in assembling the driving system.

As is clear from the foregoing description, in the modification described above, since the spacing of the developing device from the photoreceptor surface can be effected by rotating the developing device about the single pin with the developing device adapted to return to the original position by its own weight, the movement of the developing device is very smooth and without any variations in the set position thereof in the copying appratus relative to the photoreceptor surface, by which arrangement such defects as spilling of developing material or uneven developing experienced in conventional devices can be completely eliminated with consequent clear and definite copied images.

Moreover, since the levers for spacing the developing device and the residual toner removing device from the photoreceptor unit are adapted to project in front of the photoreceptor unit in the normal operative condition when these devices are set in the copying apparatus, the photoreceptor unit can not be drawn out of the copying apparatus unless the developing device and the residual toner removing device are kept away from the photoreceptor surface, and thus unwanted damage to the photoreceptor surface can be advantageously avoided.

Furthermore, the engaging mechanism E for the connections between the driving shaft and the driven shaft of each unit or device as described in the above modification in connection with the photoreceptor unit 403 is very advantageous in the copying apparatus of the above described type in which each device is adapted to be drawn out of the apparatus, since the driving shaft can readily be engaged with the driven shaft of each device very accurately. In the photoreceptor unit described above, such defects as vibration due to imperfect alignment of the axes of the driving shaft and the driven shaft, uneven transferred images, uneven developing, indefinite focusing, irregular charging on the photoreceptor surface and errors in synchronization which are inherent in the conventional engaging means can be completely eliminated with consequent simple handling of the units and devices and with very accurate transmission of the driving force to the driven shafts.

Needless to say the engaging mechanism of the above modification may be applied to a drum type photoreceptor, and the same is also applicable to other devices formed into units for insertion into or drawing out of the apparatus, for example, the copy paper feeding device, the fixing device, the copy paper roll loading device, the residual toner removing device, the toner dispensing device, etc.

Referring to FIG. 19, the driving system of the copying apparatus of the invention will be described hereinbelow.

A chain 301 is directed around a sprocket 229*s* fixedly mounted on a driving shaft (not shown) of a main motor MM, and around a sprocket 200S and a sprocket 201S. The sprocket 200S is fixed on the same shaft as a roll paper feeding clutch 230C for driving the paper feeding rollers 120 and 120'' (FIG. 5), while the sprocket 201S is connected to a sprocket 232S by a clutch 231C. The sprocket 232S is connected by a chain 302 to a sprocket 202S fixed on the same shaft as a gear 233G for driving the conveyor belt 150C (FIG. 5) with the gear 233G engaging a gear 234G which is in integral connection with a sprocket 203S. The sprocket 203S is connected by a chain 303 to a sprocket 204S fixed on the same shaft as a gear 235G which in turn meshes with a gear 205G for driving the conveyor belt 150*a* (FIG. 5).

On the other hand, a sprocket 236S fixed on the same driving shaft of the motor MM as the sprocket 229S is connected to sprockets 207S and 208S by a chain 304. A sproket 237S is fixed on the same shaft as the sproket 207S, which sprocket 237S is connected by a chain 305 to a sprocket 238S for driving conveyor belts 81 and 82 (FIG. 1), while the sprocket 208S is in integral connection with a sprocket 239S which is in turn connected to a sprocket 240S by a chain 306. The sprocket 240S is connected to the driving roller 5 for the photoreceptor belt 1 by a clutch 241C. A gear 242G fixed to the sprocket 208A meshes with a gear 243G equipped with a gear 221G for driving the conveyor belt 23 (FIG. 1), which gear 221G also engages a gear 222G for driving the belt 37 (FIG. 1) for the fixing device 34. The gear 222G in turn engages a gear 245G through a cam clutch 244C with the gear 245G engaging a gear 246G equipped with a bevel gear 247G which meshes with a bevel gear 247'G. The sprocket 240S is associated with the follower roller 3 by a chain 310 and a pair of sprockets 311S sand 312S. A group of cams M for the A4 size copy paper which will be described later is fixedly mounted on a shaft 310 for the bevel gear 247'G and a gear 224G is secured to the other end of the shaft 310, which gear 224G meshes with a gear 225G which is integrally connected with a gear 226G. The gear 226G in turn meshes with a gear 227G fixed on a shaft 311 on which a group of cams N for B4 size copy paper which will be described later is also secured. A sprocket 248S fixed on a shaft of a cleaner motor CM is connected by a chain 307 to a sprocket 218S, and a sprocket 219S for driving the cleaner brush 27*b* (FIG. 1).

A timing gear 249TG for a developing motor DM is connected by a chain 308 to a timing gear 212TG, and timing gears 213TG and 213TG' for driving shafts for the stirring vanes 18*b* and 18*d* in the developing device 15 (FIG. 5). The timing gear 212TG is fixedly mounted on the same shaft as a gear 250G for driving the outer cylinder 18*a* for the developing device 15 (FIG. 5), which gear 250G is connected, through planetary gears 214G and 215G, to gears 216G and 217G for rotating the spiral brushes 20*a* for the toner dispenser 19, and also connected to a gear 218G for driving the bucket conveyor 18*e* of the developing device 15 (FIG. 5).

A sprocket 251S fixedly mounted on a driving shaft (not shown) of a paper feeding motor FM is connected by a chain 309 to a sprocket 211S for driving a cut paper transportation roller 139 (FIG. 1).

A sprocket 252S for the rotary solenoid CS is connected by a chain 311 to a sprocket 220S for actuating the cutter 132 (FIG. 5) for the paper web from the paper roll R'.

Referring to FIGS. 20 and 21, each of the cams in the cam groups M and N is provided with an actuator or actuators *t* as shown in FIG. 20 and is adapted to sequentially actuates microswitches PSW1*a*, PSW1*b*, and CSW1*a* to CSW9*a* or CSW1*b* to CSW9*b* disposed in an electrical circuit described later. Each of the cam actuators *t* is arranged to effect formation of the latent image in association with the movement of the photoreceptor belt 1 as shown in FIG. 21.

Referring now to FIGS. 23 to 26, the electrical circuit for the copying apparatus of the invention will be described hereinbelow.

Figure 24:
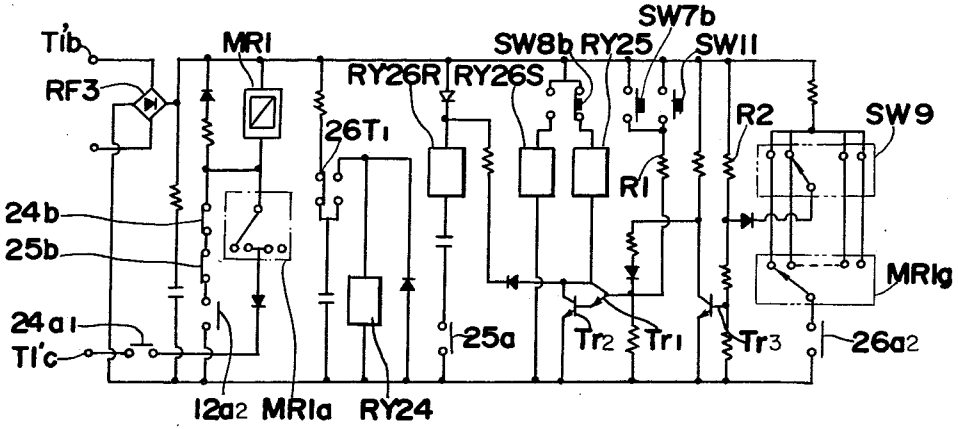
Figure 25:
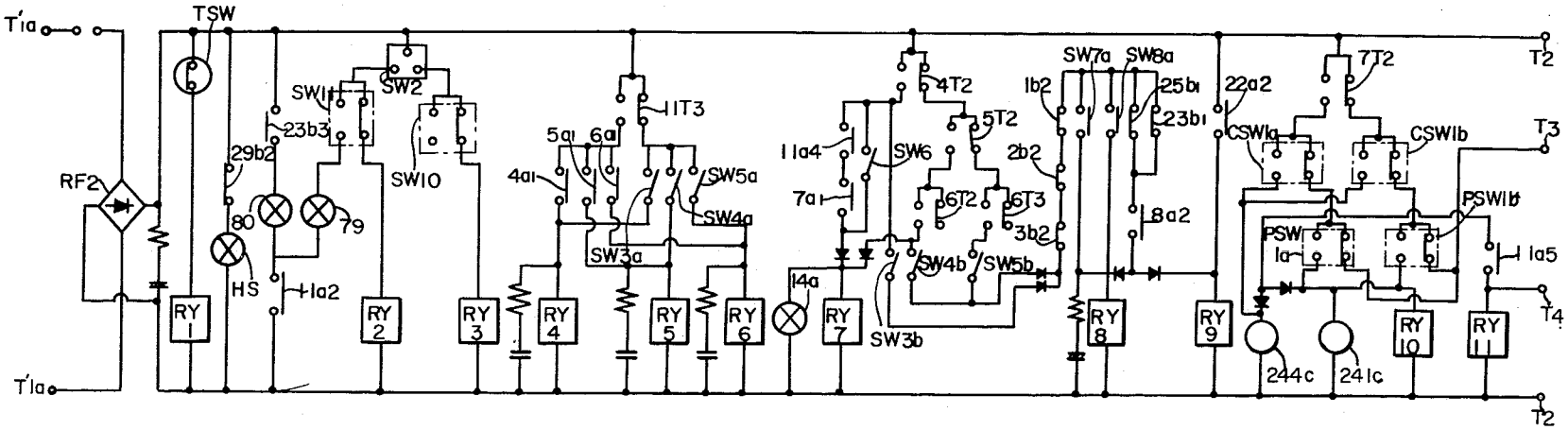

It is to be noted here that an output terminal T1*a* of the transformer T1 for a d.c. circuit in FIG. 23 (which is an a.c. circuit) is connected to a terminal T'1*a* of a rectifier RF2 in FIG. 25 (which is a d.c. circuit), while the other output terminal T1*b* of the same is connected to a terminal T'1*b* of a rectifier RF3 in FIG. 24 (which is the circuit for continuous copying control). Terminals T2 at the right end of FIG. 25 are connected to terminals T'2 in FIG. 26 (image formation control).

In the a.c. circuit of FIG. 23 which is connected to a power source (not shown) through a plug P, elements described below are connected in parallel through main switches SW1*a* and SW1*b* which are associated with each other. These elements are the transformer T1 for the d.c. circuit, the infrared lamps 35 equipped with a temperature control circuit H and enclosed in the fixing device 34, a power source circuit B for flash lamps connected to a contact 19*a*1, the flash lamps 8 and 8' and a contact 9*b*1 being connected to a flash trigger circuit I which is actuated upon closure of a contact 18*a*, a motor LM for exchanging lenses connected to contacts 2*a*1 and 3*a*1 which are connected in parallel to each other, the main motor MM, the suction device 51 for the belt unit, a cleaner motor CM connected to a contact 10*a*1 through a contact 9*a*2, the photoreceptor erasing lamp 26 and the photoreceptor belt erasing corona device D, a contact 11*a*1, a photoreceptor belt charging corona device E for actuating the corona charger 5 which are connected in series with a contact 12*a*1 and 23*a*1 in parallel connection with each other, cut paper feeding motors FM1 and FM2 connected to a contact 15*a*1, the rotary solenoid CS connected in series with contacts 14T2, 16*a*1 and a rectifier RF1, a developing motor DM for developing the latent image carrying surface 1' of the photoreceptor with toner powder and a magnetic brush biasing power source F for preventing blur or blush of the developed image and which is connected to parallel contacts 17*a*1, 18*a*1, and 20*a*1, and to parallel contact 14T2, and the transfer corona charger 21 is connected to contacts 20*a*2 and 20*a*1 which are in parallel with each other.

In the d.c. circuit shown in FIG. 25 which is connected, through the rectifier RF2, to the output terminal T1*a* of the transformer T1 for the d.c. circuit of FIG. 23, the elements described below are connected in parallel. These elements are a relay RY1 connected to a thermoswitch TSW which is enclosed in the fixing device 34 so as to dectect that the temperature in the device 34 is raised to a level sufficient for fixing, the solenoid HS for air flow regulation in case of paper jamming, which solenoid HS is connected to a contact 29*b*2, a lens selecting switch SW2 for selecting full scale or contraction scale copying according to the operator's action, a switch SW11 for confirming that the focusing lenses 11 and 12 for the full scale and contraction scale copying have reached predetermined positions, relays RY2 and RY3 connected to a switch SW10, a solenoid 79 for erasing the charge at the edges of latent images, which solenoid 79 is connected to the switches SW2, SW11 and the contact 11*a*2 and is intended to prevent toner powder from adhering to both edges of the image formed portions in the direction parallel to the movement of the photoreceptor 1 during contraction copying, a solenoid 80 for erasing charge at the portions between portions having images thereon which solenoid 80 is connected to contacts 23*b*3 and 11*a*2, a relay RY4 connected to a contact 11T3 and a contact 4*a*1 which is connected in parallel to a switch SW3*a* for selecting cut copy paper sheet or roll copy paper by the operator's manipulation, a relay RY5 connected to a size selecting switch SW4*a* (to be closed for A4 size copying) through the contact 11T3 for selecting size of the roll of copy paper during copying, a relay RY6 connected to a size selecting switch SW5*a* (to be closed for B4 size copying) through the contact 11T3, a contact 4T2 for controlling the formation of the images on the photoreceptor surface 1' so that the surface 1' is divided into three parts for B4 size coping and four parts in A4 size coping per one revolution of the photoreceptor belt 1, a relay RV7 connected to a sheet size detection switch SW6 or contacts 5T2 and 6T2, the solenoid 14*a* for actuating the light shielding plate 14*b* (FIG. 1) connected to the relay RY7 intended to move the plate 14*b* for preventing unnecessary exposure of the photoreceptor belt 1 in the A4 size copying, the contact 4T2 also for starting the copying operation, a switch SW3*b* associated with the switch SW3*a* for selecting cut paper sheet and roll paper or the contacts 5T2 and 6T2, a switch SW4*b* associated with the size selecting switch SW4*a* or contacts 5T2 and 6T3, contacts 3*b*2, 2*b*2 and 1*b*2 through parallel connection of SW5*b* associated with the size selecting switch SW5*a* and through a diode, a relay RY8 connected to a single sheet copying switch SW7 or a continuous copying switch SW8, contacts 25*b*1 and 23*b*1 in parallel connection to each other which are in turn connected in parallel to the single sheet copying switch SW7 or the continuous copying switch SW8 through a diode, and a relay RY9 connected to a contact 8*a*2 or a contact 22*a*2.

A control circuit for causing each of the above elements to function for the necessary copying operation is shown at the right of FIG. 25 and in FIG. 26 mainly includes cam switches described below which detect timings for the operation in cooperation with the cam groups M and N associated with the movement of the photoreceptor belt 1.

The above described control circuit mainly controls the movement of the photoreceptor belt 1, rotation of the cam groups M and N, the charging, exposure, developing, transfer, charge erasing, cleaning and unnecessary charge erasing of the portion of the photoreceptor belt 1 other than that having the image thereon, selection or feeding of cut copy paper sheet or paper web from the paper roll in the transportation of the copy paper sheet, transportation of the copy paper sheet after a stand-by period of the sheet for coinciding the leading edge of the copy paper sheet into coincidence with that of the toner powder image on the belt 1, cutting of the paper web from the paper roll and the stopping of the photoreceptor belt 1.

In the, above control circuit, elements mentioned below are connected in parallel. These elements are a contact 7T2, a cam switch CSW1*a* for came 1*a* and 1*b*, the photoreceptor belt clutch 241*c* which is connected to the contact 7T2, cam switches CSW1*a* and CSW1*b*, and cam switches PSW1*a* and PSW1*b* for the photoreceptor belt cams *a* and *b*, a relay 10 which is connected in parallel to the clutch 241*c* for actuating the cleaner motor CM, the corona charger 5 and the erasing corona device D for the photoreceptor belt 1, a relay RY11 for determining the time for stopping the movement of belt connected to contacts 12*a*3, 13*a*3, 14*a*3, 17*a*3 and 18T3 which are connected in parallel through respective diodes, a switch MS1 for copy paper sheet feeding stand-by, a contact 20*a*3, contacts 21*a*2 and 7T8 and cam switches CSW8*a* and CSW8*b* and a contact 28*a*1, a relay RY12 for actuating the charging corona device E and a pre-set counter, which relay RY12 is connected to the contact 7T2, the cam switches CSW1*a* and CSW1*b*, and the cam switches PSW1*a* and PSW1*b* for the belt cams *a* and *b*, and contacts 8*a*1 and 9*a*1, a relay RY13 connected to contacts 12*a*3 and 7T3 and the cam switches CSW1*a* and CSW2*b* for de-energizing the solenoid 80 through a contact 23*b*3 of a relay RY23, a relay RY14 connected to contacts 13*a*3 and 7T4 and cam switches CSW3*a* and CSW3*b* for energizing the developing motor DM and the magnetic brush biasing power source F, a relay RY15 connected to contacts 14*a*3, 4T3 and 18*b*2 for energization of the cut paper feeding motor FM to start feeding of the copy paper, a clutch 230*c* for feeding from the paper roll, which clutch 230*c* is connected to the contacts 14*a*3, 4T3 and 6T5 and cam switches CSW4*a* and CSW4*b*, a relay RY16 connected to the contacts 14*a*3, 4T3 and 6T5 and cam switches CSW4*a* and CSW4*b* for the actuation of the roll paper cutting solenoid CS, a relay 17 connected to contacts 14*a*3 and 7T5 and cam switches CSW5*a* and CSW5*b* for the actuation of the solenoid 80, a relay RY18 connected to contacts 17a3 and 7T6, and cam switches CSW6a and CSW6b for energizing the momentary exposure flash lamps 8 and 8', a relay RY19 connected to contacts 18T3 and 19a3 or to contacts 12a3 and 13a3 through diodes for actuating the flash lamp power source circuit B, a relay RY20 connected to contacts 19T3 and 7T7 and cam switches CSW7a and CSW7b for de-energizing the developing motor DM and the magnetic brush biasing power source F, a copy paper sheet transportation clutch 231c associated with the stand-by switch MS1 disposed in the path of copy paper sheet, and contacts 20a3 and 11a 6, a relay RY21, a relay RY27 for the first paper jamming detection which is associated with cam switches CSW8a and CSW8b, a paper jamming detection switch MS2 disposed in the path of the paper in a position ahead of the fixing device and a contact 24a1, a first jamming warding pilot lamp PL1 connected to the contact 27a1, a relay RY18 connected to a normally open contact of the switch MS2 and contacts 28a1 and 7T9, and cam switches CSW9a and CSW9b, a relay RY29 for the second paper jamming detection which is connected to cam switches CSW9a and CSW9b, the paper jamming detection switch MS3 disposed in the path of the paper after the fixing device, and a contact 29a1 through a diode, a second paper jamming warning lamp PL2 connected to the contact 29a1, a relay RY22 connected to a timer circuit Tmthrough the relay RY11 for de-energizing the relay RY9 to complete the copying operation, and a relay RY23 connected to a contact 13a2 and contacts 23a2 and 17b3 in parallel to the contact 13a2 for energizing the erasing solenoid 80 and de-energizing the charging corona device E.

Referring back to FIG. 24, in the circuit which is connected to the output terminal T1b of the transformer T1 for the above described d.c. circuit through the rectifier RF3, the elements described below are connected in parallel. These elements are a counter solenoid MR1 which counts the number of copies each time a contact 12a2 closes, a set switch SW9 connected to a contact MR1a advancing in association with the actuation of the counter solenoid MR1 for setting the required number of copies to be made, a pair of memory relays RY26R and RY26S provided for memorizing the depressing of the continuous copying switch SW8b and for releasing the memory when the required number of copies has been made, a relay RY25 to which the switch SW8b and transistors Tr1 and Tr2 are connected in series, a relay RY24 connected to a contact 26T1 for stopping the advancement of the counter solenoid MR1, and a contact MR1a connected in series with the counter solenoid MR1 and a contact 24a1 and associated with a contact MR1b for re-setting back to an original position.

Referring now to FIG. 22 and also back to FIGS. 20 and 23 to 26, the operation of the copying apparatus of the invention for single sheet copying will be described hereinbelow.

Upon pressing the main switches SW1a and SW1b sa as to turn then on, the infrared lamps 35, the main motor MM and the suction device 51 are energized. Subsequent depression of the print switch SW7a for single copying causes the relays RY8 and RY9 to be energized with the contact 8a2 closed and with the relay RY8 being self-retained through the normally closed contact 23bl and the diode.

In the control circuit, the contacts 8a1 and 9a1 are closed by the energization of the relays RY8 and RY9. Since the cam switches CSW1a or CSW1b and the photoreceptor belt cam switches PSW1a or PSW1b closed at the positions shown in the drawing when the photoreceptor cams a and b, and the cam 1a or 1b are back in the predetermined positions, the relay RY12 is actuated through the contact 7T2, the switch CSW1a or CSW1b, the switch PSW1a or PSW1b and the contacts 8a' 1 and 9a1. When the contact 12a3 is closed upon actuation of the relay RY12, the relay RY11 is actuated through the diode to close the contact thereof 11a5, through which the cam clutch 244c, the photoreceptor belt clutch 241c and the relay RY10 are actuated through the diode, with the cam groups M and N, the photoreceptor belt 1 and the photoreceptor belt cams a and b starting to rotate. The relay RY19 is also energized through the closure of the contact 12a3 with the contact 19a1 closed, by which the flash lamp power source circuit B is energized for preparation for turning the flash lamps 8 and 8' on. Upon energization of the relay RY11, the copy paper sheet transportation clutch 231c is actuated through the switch MS1 and the contact 11a6 thereof. The relay RY19 is self-retained through the contacts 13a3 and 18T3, while the relay RY12 is also self-retained through the contacts 12a3 and 7T3 and the cam switches CSW2a or CSW2b.

Furthermore, since the contacts 11a1 and 12a1 are closed by the energization of the relays RY11 and RY12, the charging corona device E (the corona charger CC) for charging the photoreceptor belt 1 is energized with the solenoid 80 actuated through the contact 23b3 for erasing the charge on the portions between the image carrying portions. On the other hand, when the contraction copying lens is selected, the solenoid 79 is actuated simultaneously with the closure of the switch SW11 for erasing the charge on the portions at the side edges of the image carrying portions.

The closure of the contact 10a1 by the energization of the relay RY10 causes the cleaner motor CM to start rotation with the photoreceptor belt erasing lamp 26 and the photoreceptor belt erasing corona device D energized.

When the cams 2a or 2b for de-energizing the solenoid 80 actuate the cam switches CSW2a or CSW2b through the rotation of the cam groups M and N, the relay RY13 is actuated and self-retained through the contacts 13a1 and the cam switches CSW2a or CSW2b, while the contact 13a2 is closed by the energization of the relay RY13 to actuate the relay RY23 with the contact 23a2 thereof closed and the relay RY23 self-retained, and with the contact 23b3 switched over to de-energize the solenoid 80. The relay RY12 is de-energized when the contact 8a1 is opened by the de-energization of the relay RY8 through the opening of the contact 23b1 by the actuation of the relay RY23, and upon opening of the cam switches CSW2a or CSW2b, in which case the charging corona device E continues to function since the contact 23a1 is closed through the actuation of the relay RY23 although the contact 12a1 is opened.

The relay RY13 is de-energized while the relay RY14 is energized by the further rotation of the cam groups M and N for depressing the cam switches CSW3a and CSW3b by the cam 3a or 3b.

Upon energization of the relay RY14 with the contact 14a3 thereof closed, depending on the state of the switching contact 4T3 (in the drawing, the contact 4T3 is on the roll paper feeding side and can be switched over to the cut paper feeding side when necessary) the cut copy paper sheet or the web from the paper roll is fed. In other words, in the case of cut paper sheet feeding, the relay RY15 is energized through the contact 18b2 for rotating the cut copy paper sheet feeding motor FM connected to the contact 15a1, while the feeding copy paper from the paper roll, the roll paper feeding clutch 230c is actuated through the contact 6T5 and the cam switch CSW4*a* or CSW4*b*.

Simultaneously, the contact 14T2 is switched over by the energization of the relay 14 so as to energize the developing motor DM and the magnetic brush biasing power source F, while the relay RY14 is self-retained with the contact 14a3 thereof closed through the relay RY15 or the roll paper feeding clutch 230c and the doide. The developing motor DM and the biasing power source F continue to be energized even after the de-energization of the relay RY14 through the contacts 17a1, 18a1 and 20a1.

When the cam 5a or 5b depresses the cam switch CSW5*a* or CSW5*b* through further rotation of the cam groups M and N, the relay RY17 is actuated with the contact 17b3 thereof opened to de-energize the relay RY23. Upon closure of the contact 23b3, the solenoid 80 is re-energized with the charging corona device E being de-energized simultaneously. The relay RY17 with the contact 17a3 closed is self-retained through the contact 17a3, the contact 7T6 and the cam switch CSW6*a* or CSW6*b*.

Further rotation of the cam groups M and N for depressing the cam switch CSW6*a* or CSW6*b* by the cam 6a or 6b causes the relay RY17 to stop functioning with simultaneous energization of the relay RY18. Upon closure of the contact 18a1 by the energization of the relay RY18, the flash lamp trigger circuit I is energized for momentarily energizing the flash lamps 8 and 8' so as to illuminate the exposure surface 6 on the photoreceptor belt 1. Simultaneously, the contact 18T3 is switched over to hold the relay RY18 through the contacts 18T3 and 7T7, and the cam switch CSW*a* or CSW7*b*, while the relay RY19 is de-energized upon energization of the relay RY18 with the contact 19a1 of the relay RY19 being opened to de-energize the flash lamp power source circuit B.

The transportation of the copy paper will be described hereinbelow.

When the leading edge of the copy paper fed through the actuation of the cut copy paper sheet feeding motor FM or the roll copy paper sheet feeding clutch 230c depresses the copy paper sheet stand-by switch MS1 disposed in the path of the copy paper sheet, the switch MS1 is switched over to the contact 20a3 thereof with the copy paper transportation clutch 231c connected to the connect 11a6 being de-energized, and the copy paper temporarily stops at a stand-by position determined by the position of the switch MS1.

Subsequent rotation of the cam groups M and N depresses the cam switch CSW7*a* or CSW7*b* by the cam 7a or 7b, the relay RY20 is actuated with the contact 20a3 thereof closed and with the clutch 231c is re-energized for feeding the copy paper forward from the stand-by position (re-starting of the paper feeding).

In the re-starting of the paper feeding in the case of cut copy paper sheets, since the contact 15a1 is opened upon de-energization of the relay RY15 connected to the contact 18b2 which is opened by the energization of the relay RY18, the cut paper feeding motor FM stops functioning, in which case a sheet of copy paper has already been fed from the cut copy paper section 123 and is being transported by the functioning of the clutch 231c. The relay RY14 connected to the relay RY15 through the diode stops functioning upon opening of the contact 18b2.

On the other hand, in the case of roll copy paper feeding, when the cam 4a or 4b depresses the cam switch CSW4*a* or CSW4*b* as the cam groups M and N rotate, the roll paper feeding clutch 230c stops functioning to suspend the feeding of paper web from the paper roll and simultaneously the relay RY16 is energized with the relay RY14 connected to the roll paper feeding clutch 230c through the diode stopping functioning to close the contact 14T2 and the contact 16a2, which causes the rotary solenoid CS to function through the rectifier RF1 so as to cut the paper web into the predetermined size. The relay RY16 is adapted to keep functioning for a certain period of time through a capacitor connected to the contact 16T3 and to stop functioning after a predetermined short period of time, in which time the contact 16a1 connected to the rotary solenoid CS is also opened to de-energize the rotary solenoid CS.

A description will be given hereinbelow of the re-starting of the copy paper sheet.

When the sheet of trailing edge of the copy paper passes the copy paper sheet stand-by switch MS1 by the actuation of the relay RY20 and the copy paper transportation clutch 231c, the contact of the switch MS1 returns to the original position shown in the drawing with the relay RY21 connected to the switch MS1 and the contact 20a4 actuated to close the contact 21a2 thereof and with the relay RY21 being self-retained through the contact 21a2, the contact 7T8 and the cam switch CSW8*a* or CSW8*b*. On the other hand, as the current from the switch MS1 is stopped, the relay RY20 stops functioning with the contact 20a1 thereof opened and with the developing motor DM and the magnetic brush biasing power source F de-energized.

After the copy sheet of paper passes the transfer position and the image to be copied has been transferred thereonto upon contact of the sheet with the toner powder image on the photoreceptor belt 1, the leading edge of the copy sheet of paper passes the paper jamming detection switch MS2 disposed in the path of the copy paper sheet between belt 1 and the fixing device 34, and subsequently when the cam 8a or 8b depresses the cam switch CSW8*a* or CSW8*b* after a short period of time after the departure of the trailing edge of the copy paper sheet from the belt 1 (i.e., the third actuation of the cam 8aor 8b in FIG. 20), the relay RY21 stops functioning with the contact 21a1 thereof opened and consequently with the transfer corona charger 21 de-energized.

If the copy sheet of paper is not separated from the belt 1, a warning will be given through the cam switch CSW8*a* or CSW8*b*, the first jamming detection switch MS2, the relay RY27 and the first jamming warning lamp PL1. In other words, when the sheet of copy paper is normally separated, the sheet of copy paper passes the first jamming detection switch MS2, during which time the cam switch CSW8*a* or CSW8*b* is adapted to function temporarily. The relay RY27 connected to the cam switches CSW8*a* and CSW8*b* and the switch MS2 do not function even if the contact of the cam switch CSW8*a* or CSW8*b* is switched over to a side opposite to that shown in the drawing, since the switch MS2 has already been switched over to a normally open contact thereof (opposite to the side shown in the drawing) by the passage of the sheet of copy paper. Should the jamming of the copy paper occur, since the switch MS2 is switched over to the normally closed contact side thereof, the relay RY27 is energized upon switching of the cam switches CSW8*a* and CSW8*b* with the contact 24*a*1 closed and the first jamming warning lamp PL1 is turned on.

A description will be given hereinbelow of the operation when the sheet of copy paper is normally transported.

Following the functioning of the cam switches CSW8*a* or CSW8*b*, the relay RY28 connected to the normally open contact (to be closed upon passing of the copy paper sheet) of the switch MS2 is energized and self-retained through the contact 28*a*1 thereof, the contact 7T9 and the cam switches CSW9*a* and CSW9*b*.

When the cam switch CSW9*a* or CSW9*b* is depressed by the cam 9*a* or 9*b* as the cam groups M and N further rotate, the sheet of copy paper is passing the second paper jamming detection switch MS3 disposed in the path of the copy paper after the fixing device 34. Similarly to the jamming detection described above, the relay RY29 connected to the cam switches CSW9*a* and CSW9*b* and the switch MS3 does not function when the copy paper is transported normally, but functions only when paper jamming occurs, for giving a warning by the second jamming warning lamp PL1 connected to the contact 29*a*1 and for opening the contact 29*b*2 (FIG. 26) and de-energizing the air flow direction changing solenoid HS so that air flow normally directed toward the photoreceptor belt 1 is directed to the fixing device 34 and so that the infrared lamps 35 are turned off through the temperature regulating circuit H connected to the contact 29*b*3 (FIG. 23) for rapidly cooling the fixing device 34 so as to prevent fire.

Reverting to the description of the single sheet copying, the relay RY11 connected to the contact 21*a*2, the contact 7T8 and the cam switch CSW8*a* or CSW8*b* is de-energized, since the contact 28*a*1 is opened through the de-energization of the relay RY28 and the relay RY22 connected through the timer circuit is de-energized after a predetermined period of time with the contact 22*a* thereof opened and with the relay RY9 connected to the contact 22*a*2 de-energized. In the relays RY8 and RY9 actuated by the depression of the print switch SW7*a* for the single sheet copying and self-retained thereafter by the contacts 23*b*1 and 8*a*2, the relay RY8 stops functioning as the relay RY23 is energized, with the contact 23*b*1 thereof opened, but upon depression of the single copy print switch SW7*a* again when the relay RY23 stops functioning, a second copying with a single sheet is re-started.

Figure 26:
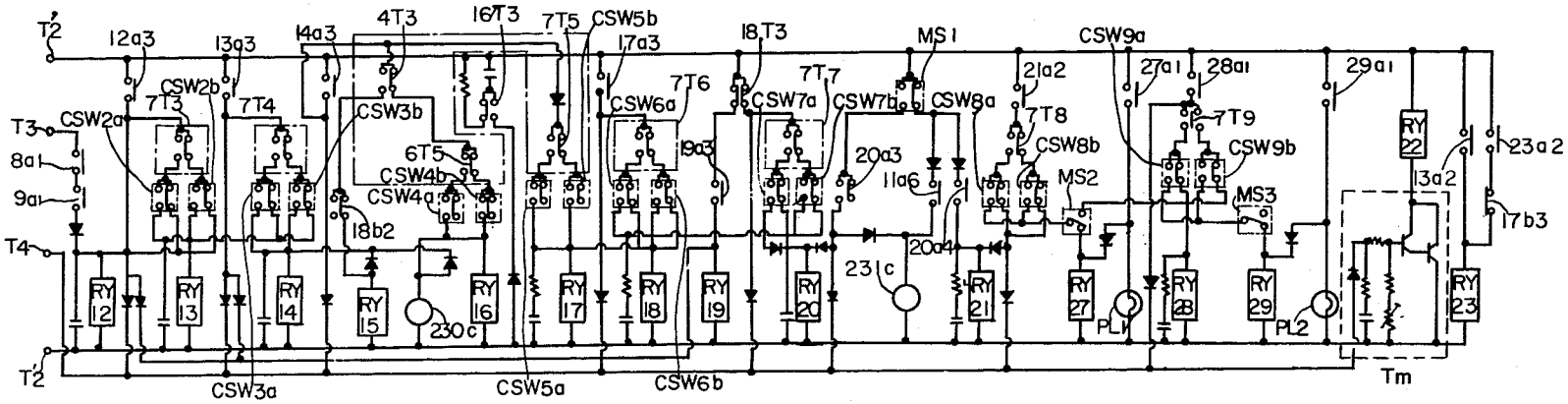

In making B4 size copies, the cam groups M and N close the cam switches CSW1*a* to CSW9*a* sequentially in the order shown in the upper column of the table in FIG. 26, and each element is actuated in the order maked with a circle for the first sheet of copy paper. For example, after the actuation of the cam 2*a* or 2*b*, the cam 7*a* or 7*b*, the cam 8*a* or 8*b* and the cam 4*a* or 4*b* are sequentially actuated to depress the cam switches CSW7*a* or CSW7*b*, CSW8*a* or CSW8*b* and CSW4*a* or CSW4*b*, in which case, however, the relays 20, 21 and 16 are not energized and when the cam 3*a* or 3*b* depresses the cam switch CSW3*a* or CSW3*b*, the relay RY14 is energized for continuation of the copying operation.

The continuous copying operation will be described hereinbelow.

Initially, the desired number of copies to be made is set by the operator by means of the setting switch 9. Subsequent depression of the continuous copying switch SW 8*b* causes the relay RY25 to stop functioning with the contact 25*a*3 thereof opened and with the memory relay RY26S (setting side) actuated for closing the contact 26*a*2. In the normal condition, the transistor T*r*3 is on through a resistor R2, while transistors T*r*1 and T*r*2 remain off. In this condition, the contacts MR1 and MR1*b* of the counter solenoid MR1 advance by the opening or closure of the contact 12*a*2 associated with the relay RY12 and when reaching the pre-set number of copies, the transistor T*r*3 is turned off, while the transistors T*r*1 and T*r*2 are turned on by which the relay RY25 is energized with the contact 25*a*3 thereof closed and with the memory relay RY26R (re-setting side) actuated. The contact 26T1 is switched over to the side of the relay RY24 by the actuation of the memory relay RY26R (re-setting side) and the relay RY24 continues to be energized for a fixed period of time. The actuation of the relay RY24 opens the contact 24*b* for stopping the operation signal to the counter solenoid MR1 from the relay RY12. The returning of the contact MR1*b* to the original position is effected by applying an a.c. pulse voltage to the counter solenoid MR1, when the contact 24*a*1 is closed, from the terminal T1*c* of the transformer T1 for the d.c. circuit (FIG. 23) to the re-setting terminal T1'*c* through the counter solenoid MR1, the contact MR1*a* and the contact 24*a*1, and when the counter solenoid MR1 is energized, the contacts MR1*a* and MR1*b* are stopped at the position shown in the drawing (the original position). Since the contact 25*b*1 of the relay RY25 is opened by the actuation of the relay RY25 when the set number of copies has been made, the relay RY8 remains de-energized after the opening by the actuation of the relay RY23. Accordingly, the relay RY12 is not actuated further when the continuous copying is completed.

As is clear from the foregoing description, in the copying apparatus of the invention, the photoreceptor belt is movably suspended by a plurality of rollers including the driving roller in the form of an approximate triangle with one side of the triangle facing the transfer corona charger further provided with the idling roller to form a flat surface for transfer. Since the various elements for carrying out the copying operation are sequentially disposed along the photoreceptor belt with the fixing device particularly located in the vicinity of the transfer means, the path required for the transportation of the copy paper has been greatly shortened with a consequent reduction in the size of the apparatus itself, which arrangement also contributes to high speed copying to a great extent. The provision of the flat surface for transfer on the photoreceptor belt is effective for increasing the area utilized for transfer as compared with the transfer at a curved portion of the photoreceptor belt in the conventional copying apparatuses, and consequently is very advantageous for high speed transfer with excellent electrostatic attraction for the copy paper. Since the above described flat portion for transfer on the photoreceptor belt is approximately parallel with the transportation path of the copy paper fed from the cut paper sheet section or the copy paper roll, the copy paper is transported in parallel relation to and uniformly adheres to the surface of the photoreceptor belt at high speed, and what is better, since the copy paper is uniformly adhering, in the flat condition, to the transfer surface of the photoreceptor belt, the charge to be imparted to the back surface of the copy paper by the transfer means is also uniform in the density of charge, thus providing clear and definite copied images with improved transfer effect.

Furthermore, the separation of the paper sheet with the copied image thereon from the photoreceptor belt is advantageously effected by the directivity and resilience of the copy paper at the acutely curved portion on the photoreceptor belt formed by the small diameter roller, and moreover, the blower means adapted to send the air flow toward the acutely curved portion for assisting in the separation of the copy paper in the normal operation and to effectively direct the air flow to the fixing device in case of emergency, such as paper jamming, is provided in the fixing device, which blower means improves the paper separation to a large extent and consequently assists in obtaining good copied images at any time since no mechanical separation means for the copy paper is required, and in case of emergency, the blower means directs the cooling air into the fixing device for preventing the dangers of unusual temperature rise in the fixing device or the burning of the copy paper.

The provision of the heat shielding means, such as the air curtain, between the fixing device and the photoreceptor belt is particularly effective for minimizing the temperature increase in the copying apparatus due to heat dissipated from the fixing means and advantageously prevents the crystalization or deterioration of the photosensitive layer of the photoreceptor belt due to an elevated temperature or melting of the residual toner collected in the residual toner removing device.

Additionally, since the photoreceptor belt is adapted to provide at least three equally sized image forming portions along the entire length of the belt with different image forming portions sequentially used in single sheet copying, uneven fatigue or deterioration of a particular part of the photoreceptor belt in a short period of time is advantageously prevented, by which arrangement the life of the photoreceptor belt is economically lengthened. On the contrary, in continuous copying, at least three copies are continuously obtained per one revolution of the photoreceptor belt, thus contributing the high speed copying. Furthermore, since the image forming portions on the photoreceptor surface are always the same, the seam or joint on the photoreceptor belt gives rise to no inconveniences, so that an expensive jointless photoreceptor belt requiring a high degree of technical skill for coating the belt with the photosensitive material is not necessary, thus resulting in a low cost of the copying apparatus, which is highly desirable from the industiral point of view.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. An image transfer type electrophotographic copying apparatus which comprises:

a photoconductive member in the form of an endless belt having the opposite ends thereof joined so that at least three equally sized latent image carrying portions can be fitted along its circumferential length;

a plurality of rollers rotatably supporting said photoconductive member to guide said endless belt along a path approximately triangular in shape so as to provide a plurality of flat surfaces therealong;

means sequentially disposed along said photoconductive member including a corona charging means for uniformly charging said photoconductive surface, an instantaneous exposure means for forming an electrostatic latent image, a developing means for developing said latent image into a visible toner powder image, an image transfer means for transferring said toner powder image onto a copy paper fed from paper feeding means, and residual toner removing means for removing residual toner from said photoconductive surface;

said image transfer means being provided along one of said flat surfaces so that the transfer of said toner powder image is effected as the copy paper adheres electrostatically onto the photoconductive surface on said flat surface;

said endless belt having an acutely curved portion following said flat surface where said image transfer means is provided for separating said copy paper, after transfer of the image thereto, mainly by its own resilience;

a fixing means for heat fixing said toner powder image on said copy paper and disposed below said residual toner removing means;

a heat shielding means disposed above said fixing means and below said residual toner removing means for shielding heat from said fixing means and comprising means for forming an air flow acting as an air curtain between said fixing means and said residual toner removing means;

and a blower means associated with said fixing means for blowing air toward said acutely curved portion to assist said separation of the copy paper from said photoconductive surface and including means for changing the direction of air flow in the event of paper jamming in said fixing means so that air from said blowing means is directed into said fixing means.

2. An image transfer type electrophotographic copying apparatus which comprises:

a photoconductive member in the form of an endless belt having the opposite ends thereof joined so that a plurality of equally sized latent image carrying portions can be fitted along its circumferential length;

a plurality of rollers rotatably supporting said photoconductive member to guide said endless belt along a path approximately triangular in shape so as to provide a plurality of flat surfaces therealong;

means sequentially disposed along said photoconductive member including a corona charging means for uniformly charging said photoconductive surface, an instantaneous exposure means for forming an electrostatic latent image, a developing means for developing said latent image into a visible toner powder image, an image transfer means for transferring said toner powder image onto a copy paper fed from paper feeding means, and residual toner removing means for removing residual toner from said photoconductive surface;

said belt having a first curved portion between said exposure means and said transfer means and supported by one of said rollers and said developing means being at a position facing said first curved portion;

said belt having a second curved portion after said transfer means and which is an acutely curved portion and supported by another of said rollers, said copy paper being separated from the surface of said belt at said acutely curved portion mainly by its own resilience;

a fixing means disposed below said residual toner removing means for fixing said toner powder image on said copy paper; and a heat shielding means for forming an air curtain between said residual toner removing means and said fixing means, said fixing means being provided with blower means having means for selectively changing the direction of air flow from said blower means, detecting means for detecting entrance and discharge of copy paper into or out of said fixing means and coupled to said means for selectively changing the direction of air flow for actuating said means for selectively changing the direction of air flow for directing said air flow toward said second curved portion of said belt to assist in the separation of said copy paper during normal copying operation, and in the event of a paper jam in said fixing means, directing said air flow into said fixing means.

3. An electrophotographic copying apparatus as claimed in claim 2 wherein the there are four rollers supporting said belt with the portion of the belt between the first and second rollers forming a first flat surface facing said exposure means, the developing means being adjacent said second roller, and the third roller being provided between the second roller and the fourth roller and the fourth roller forming said acutely curved portion of said belt, and the portion of the belt between said third and fourth rollers forming a second flat surface which faces said transfer means and which is at a small angle relative to the path for said copy paper, whereby said path for the copy paper and said second flat surface are in a substantially straight line and said copy paper is separated from said photoconductive surface by the resilience and directivity thereof and by the presence of said acutely curved portion on said belt at the end of said second flat surface.

4. An electrophotographic copying apparatus as claimed in claim 2 wherein there are three rollers supporting said belt with the portion of the belt between the first and second rollers forming a first flat surface where an electrostatic latent image is formed and the portion of the belt between said second and third rollers forming a second flat surface which said transfer means faces, said second surface being at a small angle relative to the path for said copy paper and said second flat surface and said path for said copy paper being in a substantially straight line and said acutely curved portion of said belt being after said second flat surface in the direction of movement of said belt, whereby said copy paper is separated from said belt by the resilience and directivity thereof and by the presence of said acutely curved poriton on said belt.

5. An electrophotographic copying apparatus as claimed in claim 2 wherein said blower means comprises a fan, a duct disposed on said fixing means and having one end into which said fan discharges and having at the other end a first opening facing said acutely curved portion of said photoreceptor belt and a second opening facing the inlet side of said fixing means and a partition plate member fixedly disposed in said duct for dividing part of said duct leading to said openings into a first and a second passage corresponding to said first and second openings, and an flow regulating plate member disposed adjacent to the edge of said partition plate member in said duct so as to alternately open and close said first and second passages, a pin secured to said duct on which said air flow regulating member is rotatably mounted, solenoid operated transmission means coupled to said partition plate member, said solenoid means being electrically connected to said detecting means for actuation thereby so as to turn said air flow regulating plate member in a direction to close said second passage and to open said first passage in said normal copying operation, and to turn said air flow regulating plate member in a direction to open said second passage and to close said first passage in case of said paper jamming.

6. An electrophotographic copying apparatus as claimed in claim 2 wherein said means for detecting entrance and discharge of said copy paper sheet into and out of said fixing device comprises microswitches.

7. An electrophotographic copying apparatus as claimed in claim 2 wherein said belt is adapted to have at least three equal size latent image carrying portions along the complete circumferential length thereof.

8. An electrophotographic copying apparatus as claimed in claim 2 wherein said belt is divisible into at least two different sizes of latent image carrying portions, the first size corresponding to substantially one-third the length of the belt and the second size corresponding to one-fourth the length of the belt.

9. An electrophotographic copying apparatus as claimed in claim 8 wherein said means sequentially disposed around said photoconductive member further includes a charge erasing means adjacent said corona charging means for erasing the charge on non-image carrying portions of said belt between said image carrying portions for said first and second size copying and for erasing the charge on non-image carrying portions along the side edges of said image carrying portions for said second size of latent image carrying portions in a direction parallel to the movement of said belt.

10. An electrophotographic copying apparatus as claimed in claim 2 wherein one of said rollers has a radius smaller than that of said roller facing said developing means.

11. An electrophotographic copying apparatus as claimed in claim 2 wherein said belt together with said plurality of rollers and said developing means are each in the form of a unit which can be moved into and secured in or drawn out of said copying apparatus.

* * * * *